US012454880B1

(12) United States Patent
Goshorn et al.

(10) Patent No.: US 12,454,880 B1
(45) Date of Patent: Oct. 28, 2025

(54) MECHANICAL SHAFT STOP IN A ROTATING MACHINE

(71) Applicant: Halliburton Energy Services, Inc., Houston, TX (US)

(72) Inventors: Gerald Glen Goshorn, Tulsa, OK (US); Donn J. Brown, Tulsa, OK (US); Ketankumar Kantilal Sheth, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/647,529

(22) Filed: Apr. 26, 2024

(51) Int. Cl.
*E21B 43/12* (2006.01)
*F04D 29/043* (2006.01)
*F04D 29/64* (2006.01)

(52) U.S. Cl.
CPC ..... *E21B 43/128* (2013.01); *F04D 29/043* (2013.01); *F04D 29/648* (2013.01)

(58) Field of Classification Search
CPC ..... E21B 43/128; F04D 29/043; F04D 29/648
See application file for complete search history.

(56) References Cited

U.S. PATENT DOCUMENTS 1,131,155 A 3/1915 Murphy
5,011,104 A * 4/1991 Fang ..... F16M 11/28 248/161
5,147,179 A * 9/1992 Bransch ..... F04D 29/106 415/168.2
5,174,680 A * 12/1992 Nakamura ..... F16D 1/094 301/111.01
5,660,520 A * 8/1997 Scarsdale ..... F04D 29/0413 415/199.1
5,695,297 A * 12/1997 Geib ..... F16D 1/094 403/369
5,911,421 A * 6/1999 Steele ..... B23B 31/202 279/42
7,488,137 B2 * 2/2009 Hu ..... F16D 1/096 277/622
8,292,591 B2 * 10/2012 Leso ..... F04D 29/181 416/204 R
8,400,035 B2 * 3/2013 Watson ..... H02K 7/083 310/90
9,080,437 B2 * 7/2015 Brunner ..... F04B 47/06
10,267,315 B2 * 4/2019 Chalmers ..... F04D 29/2277
10,374,481 B2 * 8/2019 Clingman ..... F04D 29/0473
11,867,176 B1 * 1/2024 Shakirov ..... E21B 43/128
12,024,990 B2 * 7/2024 Brown ..... F04D 13/10
(Continued)

*Primary Examiner* — Aaron L Lembo
(74) *Attorney, Agent, or Firm* — Conley Rose, P.C.; Rodney B. Carroll

(57) ABSTRACT

A rotating machine. The rotating machine comprises a tubular housing; a drive shaft disposed at least partly inside the tubular housing; a component disposed inside of the tubular housing that is coupled to the drive shaft and configured to do work as the drive shaft rotates; and a shaft stop assembly coupled to the drive shaft comprising a collet disposed around the drive shaft, a compressor flange disposed around the collet and around the drive shaft and engaging with the collet to compress the collet to form a friction fit with the drive shaft, and a compression stop disposed around the compressor flange and around the drive shaft, wherein a first axial end of the compression stop abuts an end of the collet.

20 Claims, 13 Drawing Sheets

(56) References Cited

U.S. PATENT DOCUMENTS

| | | | | |
|---|---|---|---|---|
| 2005/0220534 | A1* | 10/2005 | Ober | B65H 75/08 403/370 |
| 2012/0217002 | A1* | 8/2012 | Brunella | E21B 33/08 166/84.1 |
| 2019/0085667 | A1* | 3/2019 | Xiao | F04D 1/066 |
| 2024/0392789 | A1* | 11/2024 | Chalmers | F04D 29/2277 |

* cited by examiner

MECHANICAL SHAFT STOP IN A ROTATING MACHINE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Oilfield and energy recovery equipment is called upon to serve under a wide variety of operating conditions and often in harsh environments. Electric submersible pump (ESP) assemblies may be expected to operate in downhole conditions of high heat and in the presence of reservoir fluids that exhibit a wide range of gas-to-liquid ratios that change dramatically over time. ESPs may be applied to lift hydrocarbons from subterranean formations. ESPs may be applied to lift geothermal fluids to the surface, where thermal energy may be recovered from hot geothermal fluids. Horizontal pump systems (HPSs) may be disposed at a surface location and pump fluids from a surface location into a wellbore (e.g., an injection well) or may provide pressure boost to drive fluid flow in a pipeline.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
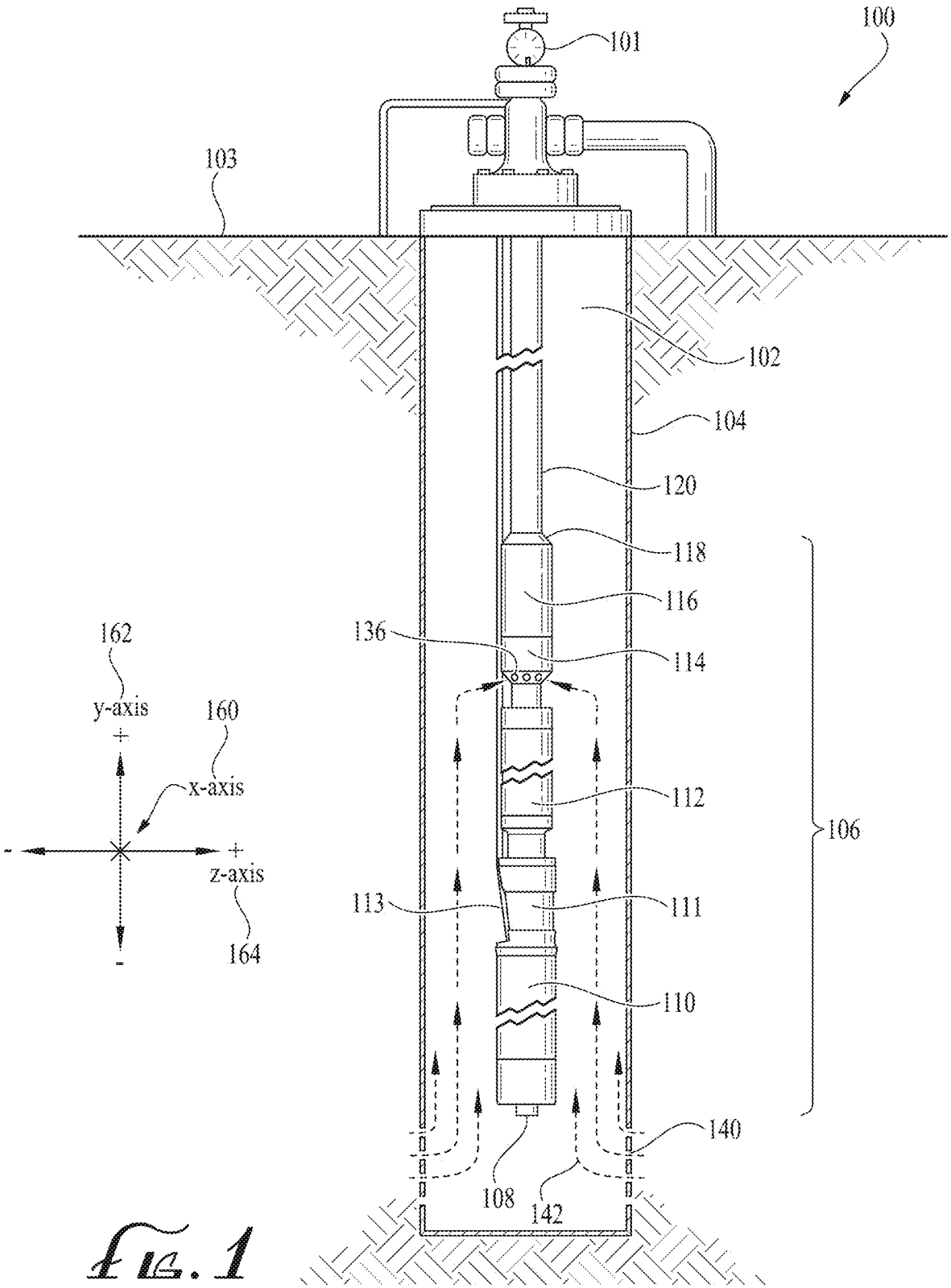
FIG. 1 is an illustration of an electric submersible pump assembly according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid. As used herein, the term "about" when referring to a measured value or fraction means a range of values+/−5% of the nominal value stated. Thus, "about 1 inch," in this sense of "about," means the range 0.95 inches to 1.05 inches, and "about 5000 PSI," in this sense of "about," means the range 4750 PSI to 5250 PSI. Thus, the fraction "about $^{8}/_{10}$s" means the range $^{76}/_{100}$s to $^{84}/_{100}$s.

Electric submersible pump (ESP) assemblies may feature a variety of rotating components. For example, ESP assemblies may comprise centrifugal pump stages that each comprise an impeller coupled to a rotating drive shaft and a diffuser that is statically coupled to a housing of the centrifugal pump. Gas separators may have rotating components such as fluid movers and/or centrifugal pump stages. Charge pumps can have pump stages that feature rotating components. Horizontal pump assemblies (HPSs) may also feature rotating components, such as impellers coupled to a rotating drive shaft. In some cases, it is desirable that rotating components float free of the drive shaft (e.g., the rotating component is free to move axially along the drive shaft within some range of motion). In other cases, however, it is desirable that rotating components not float freely and instead the rotating components are desirably axially fixed to the drive shaft so they turn with the drive shaft and do not move axially with reference to the drive shaft. In this case, the rotating components may be said to be in compression. For example, a centrifugal pump may comprise a plurality of impellers that are located by spacer sleeves on the drive shaft (e.g., the spacer sleeves may pass through a central bore of diffusers and may be coupled to the drive shaft) and stopped at one or both ends by a mechanical shaft stop. In some embodiments, the mechanical shaft stop may be axially fixed on the drive shaft by a retainer ring disposed in an outside groove of the drive shaft and in a retaining groove of an interior groove of the mechanical shaft stop. This arrangement may have disadvantages. For example, the outside groove cut in the outer surface of the drive shaft forms a point of weakness (e.g., drive shaft strength is functionally related to a diameter of the drive shaft, and a groove in the outside surface of the drive shaft reduces the diameter at that point, reducing the strength of the drive shaft at that point, thereby defining a point of weakness). A common failure mode of rotating equipment is drive shaft failure. Additionally, installation of such a retainer ring to secure a mechanical shaft stop during assembly of an item of rotating equipment can be difficult and time consuming, due to the dimensional constraints of the equipment.

The present disclosure teaches a new mechanical shaft stop assembly that avoids weakening a drive shaft by obviating the need to provide a groove in the drive shaft to receive a retaining ring and that promotes ease of rotating machine assembly. A mechanical shaft stop may comprise a compression stop defining an interior bore that slides over a drive shaft, a flexible collet that slides over the drive shaft and is received and stopped at one axial end by the compression stop, and a compression nut that slides over the drive shaft and that engages with the flexible collet, compressing the flexible collet onto an outside surface of the drive shaft to create a secure friction hold on the drive shaft, effectively affixing the mechanical shaft stop axially on the drive shaft. Two such mechanical shaft stop assemblies may be located at either end of a string of components to retain the rotating components (e.g., impellers and spacer sleeves) in compression. The disclosed mechanical shaft stop has application in pump rotating machines, in gas separator rotating machines, in charge pump rotating machines, in HPSs, and in other rotating machines.

Turning now to FIG. 1 a well site environment 100 showing a completion string disposed in a wellbore, according to one or more aspects of the disclosure, is described. The well site environment 100 comprises a wellbore 102 that is at least partially cased with casing 104. As depicted in FIG. 1, the wellbore 102 is substantially vertical, but the electric submersible pump (ESP) assembly 106 described herein also may be used in a wellbore 102 that has a deviated or horizontal portion. The well site environment 100 may be at an on-shore location or at an off-shore location. The ESP assembly 106 in an embodiment comprises an optional sensor package 108, an electric motor 110, a motor head 111 that couples the electric motor 110 to a seal unit 112, a fluid intake 114 having inlet ports 136, and a centrifugal pump assembly 116. The centrifugal pump assembly 116 comprises a plurality of centrifugal pump stages. The centrifugal pump assembly 116 comprises a novel mechanical shaft stop as disclosed further below.

In an embodiment, the electric motor 110 may be replaced by a hydraulic turbine, a pneumatic turbine, a hydraulic motor, or an air motor, and in this case the assembly 106 may be referred to as a submersible pump assembly. In an embodiment, the ESP assembly 106 may further comprise a gas separator assembly (e.g., see FIG. 5 and FIG. 6 below) that may be located between the fluid intake 114 and the centrifugal pump assembly 116. In an embodiment, the fluid intake 114 may be integrated into a downhole end of the optional gas separator. In an embodiment, the fluid intake 114 may be integrated into a downhole end of the centrifugal pump assembly 116. In an embodiment, the fluid intake 114 may be a separate component that is bolted at its downhole end to an uphole end of the seal unit 112 and bolted at its uphole end to a downhole end of the centrifugal pump assembly 116 or to a downhole end of a gas separator assembly.

The centrifugal pump assembly 116 may couple to a production tubing 120 via a connector 118. An electric cable 113 may attach to the electric motor 110 and extend to the surface 103 to connect to an electric power source. In an embodiment, where the electric motor 110 is replaced by a hydraulic turbine or a hydraulic motor, the electric cable 113 may be replaced by a hydraulic power supply line. In an embodiment, where the electric motor 110 is replaced by a pneumatic turbine or an air motor, the electric cable 113 may be replaced by a pneumatic power supply line. The casing 104 and/or wellbore 102 may have perforations 140 that allow well fluid 142 to pass from the subterranean formation through the perforations 140 and into the wellbore 102. In some contexts, well fluid 142 may be referred to as reservoir fluid.

It will be appreciated that in a different embodiment, the configuration of the ESP assembly 106 may be different. For example, in a bottom-intake design, the fluid intake 114 may be located at the downhole end of the ESP assembly 106, the centrifugal pump assembly 116 may be located uphole of the fluid intake 114, the motor 110 may be located uphole of the centrifugal pump assembly 116, and the seal section 112 may be located uphole of the motor 110. For example, in a through-tubing-conveyed completion, the order of placement of components of the ESP assembly 106 may be altered in various ways, for example with the fluid intake located at the downhole end of the ESP assembly 106, the centrifugal pump assembly 116 located uphole of the fluid intake 114, the seal section 112 located uphole of the centrifugal pump assembly 116, and the motor 110 located uphole of the seal section 112. It is understood that the novel mechanical shaft stop disclosed herein can be used to advantage in any of these alternative configurations of the ESP assembly 106.

The well fluid 142 may flow uphole in the wellbore 102 towards the ESP assembly 106, in the inlet ports 136, and into the fluid intake 114. The well fluid 142 may comprise a liquid phase fluid. The well fluid 142 may comprise a gas phase fluid mixed with a liquid phase fluid. The well fluid 142 may comprise only a gas phase fluid (e.g., simply gas). Over time, the gas-to-liquid ratio of the well fluid 142 may change dramatically. For example, in the circumstance of a horizontal or deviated wellbore, gas may build up in high points in the roof of the wellbore and after accumulating sufficiently may "burp" out of these high points and flow downstream to the ESP assembly 106 as what is commonly referred to as a gas slug. Thus, immediately before a gas slug arrives at the ESP assembly 106, the gas-to-liquid ratio of the well fluid 142 may be very low (e.g., the well fluid 142 at the ESP assembly 106 is mostly liquid phase fluid); when the gas slug arrives at the ESP assembly 106, the gas-to-liquid ratio is very high (e.g., the well fluid 142 at the ESP assembly 106 is entirely or almost entirely gas phase fluid); and after the gas slug has passed the ESP assembly 106, the gas-to-liquid ratio may again be very low (e.g., the well fluid 142 at the ESP assembly 106 is mostly liquid phase fluid).

Under normal operating conditions (e.g., well fluid 142 is flowing out of the perforations 140, the ESP assembly 106 is energized by electric power, the electric motor 110 is turning, and a gas slug is not present at the ESP assembly 106), the well fluid 142 enters the inlet ports 136 of the fluid intake 114, flows into the centrifugal pump assembly 116, and the centrifugal pump assembly 116 flows the fluid through the connector 118 and up the production tubing 120 to a wellhead 101 at the surface 103. The centrifugal pump assembly 116 provides pumping pressure or pump head to lift the well fluid 142 to the surface. The well fluid 142 may comprise hydrocarbons such as crude oil and/or natural gas. The well fluid 142 may comprise water. In a geothermal application, the well fluid 142 may comprise hot water. An orientation of the wellbore 102 and the ESP assembly 106 is illustrated in FIG. 1 by an x-axis 160, a y-axis 162, and a z-axis 164.

Figure 2:
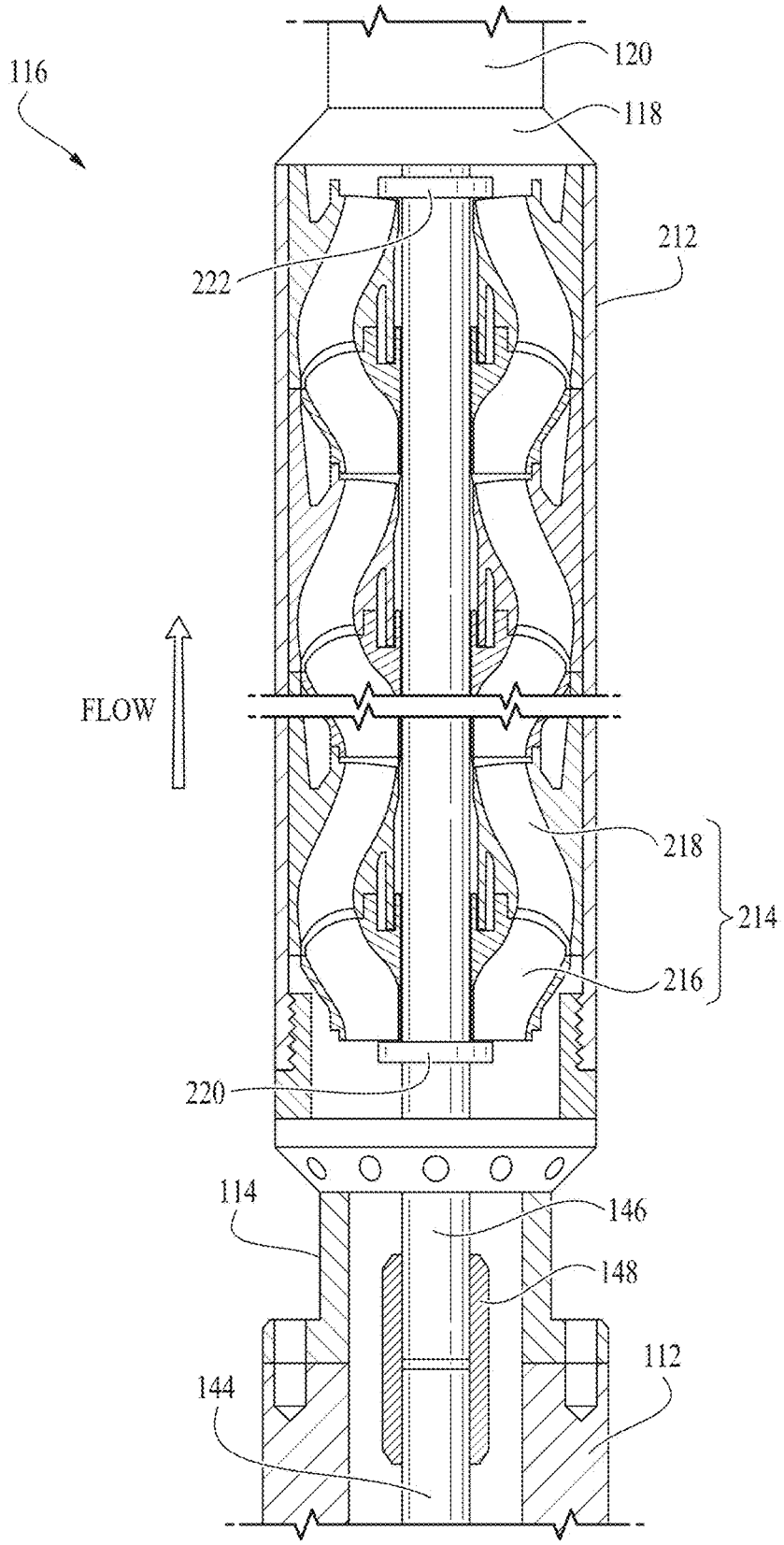
FIG. 2 is an illustration of a centrifugal pump assembly according to an embodiment of the disclosure.

Turning now to FIG. 2, a cross-section view of a plurality of centrifugal pump stages 214 is described. The pump stages 214 are enclosed within a housing 212 (e.g., a tubular housing). Each pump stage 214 comprises an impeller 216 and a diffuser 218. The pump stages 214 illustrated in FIG. 2 are illustrated having a mixed flow pump configuration. The direction of fluid flow through the pump stages 214 has a significant component of radial flow (e.g., a mixed flow of radial and axial flow direction). As well fluid 142 enters an inlet 226 of the impeller 216, it flows both up and radially outwards due to an outwards swelling inside surface of a shroud structure of the impeller 216 and due to deflection by an outer surface of a hub structure of the impeller 216 that swells outwards at an uphole end of the hub structure. As the well fluid 142 flows from an outlet 228 of the impeller 216 and flows into an inlet 237 of the diffuser 218, it flows both uphole and radially inwards due to an inwards curved outer surface of a hub structure at an uphole end of the diffuser 218 and due to deflection by an inner surface of a shroud structure of the diffuser 218 that swells inwards at an outlet at an uphole end of the shroud structure. In other embodiments, however, the pump stages 214 may have a radial flow pump configuration rather than a mixed flow pump configuration.

A drive shaft 144 of the seal section 112 may be coupled to a drive shaft of the electric motor 110 and receive rotational power from the drive shaft of the electric motor 110. An uphole end of the drive shaft 144 of the seal section 112 may be coupled via a coupling shell 148 to a downhole end of a drive shaft 146 of the centrifugal pump assembly 116. The impellers 216 are coupled to the drive shaft 146 of the centrifugal pump assembly (e.g., via a key inserted into keyways defined in the drive shaft and in the inside of the impeller 216), and the diffusers 218 are retained by the housing 212.

In an embodiment, the impellers 216 of the centrifugal pump assembly 116 are mechanically stopped on the drive shaft 146 by a first mechanical stop assembly 220 disposed near a downhole end and by a second mechanical stop assembly 222 disposed near an uphole end of the centrifugal pump assembly 116. The mechanical shaft stop assemblies 220, 222 are described further hereinafter.

Figure 3:
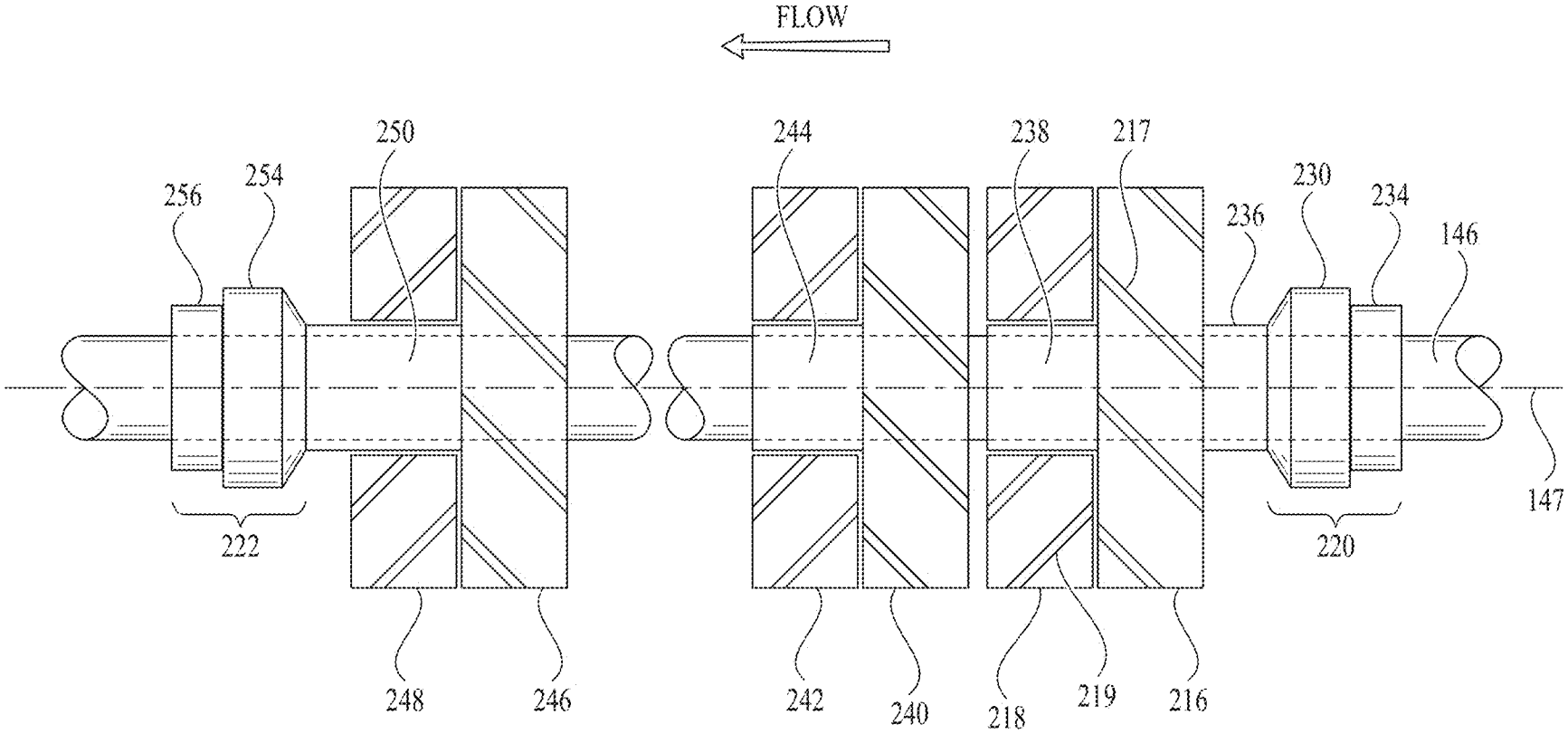
FIG. 3 is an illustration of some interior details of a centrifugal pump assembly according to an embodiment of the disclosure.

Turning now to FIG. 3, some details of internals of the centrifugal pump assembly 116 are described. The downhole end of the internals is on the right side of FIG. 3 and the uphole end of the internals is on the left side of FIG. 3. Flow of fluid 142 through the internals is from right to left (from downhole to uphole). The internals are assembled on the drive shaft 146 having a centerline 147. In an embodiment, a first mechanical shaft stop 220 comprises a first compression stop 230 and a first compression nut 234. A collet 232 is disposed between the first compression stop 230, and the first compression nut 234 as described more fully below with reference to FIG. 4A, FIG. 4B, FIG. 4C, FIG. 4D, FIG. 4E, and FIG. 4F. When the first mechanical shaft stop 220 is assembled as illustrated in FIG. 3, the first compression nut 234 urges the collet 232 leftwards into radial compression, causing the collet 232 to establish a friction fit of the first mechanical shaft stop 220 on the drive shaft 146.

A first sleeve 236 is coupled to the drive shaft 146, and a right side of the first sleeve 236 is in contact with or abuts a left side of the first compression stop 230. The first sleeve 236 is free to rotate with the drive shaft 146. A first impeller 216 comprising a plurality of vanes 217 is coupled to the drive shaft 146, and a right side of the first impeller 216 is in contact with or abuts the left side of the first sleeve 236. A second sleeve 238 is coupled to the drive shaft 146, and a right side of the second sleeve 238 is in contact with or abuts a left side of the first impeller 216. A first diffuser 218 having vanes 219 is disposed over the second sleeve 238. The first diffuser 218 is statically held in place by the housing 212 of the centrifugal pump assembly 116, and the second sleeve 238 is free to rotate with the drive shaft 146 within a bore defined within the first diffuser 218. A second impeller 240 is coupled to the drive shaft 146, and a right side of the second impeller 240 is in contact with or abuts the left side of the second sleeve 238. A third sleeve 244 is coupled to the drive shaft 146, and a right side of the third sleeve 244 is in contact with or abuts a left side of the second impeller 240. A second diffuser 242 is statically held in place by the housing 212 of the centrifugal pump assembly 116, and the third sleeve 244 is free to rotate with the drive shaft 146 within a bore defined within the second diffuser 242.

A third impeller 246 is coupled to the drive shaft 146. It is understood that a plurality of centrifugal pump stages (each stage comprising an impeller, a sleeve, and a diffuser located over the sleeve, and a leftmost sleeve in contact with or abuts a right side of the third impeller 246) may be disposed between the second diffuser 242 and the third impeller 246. A fourth sleeve 250 is coupled to the drive shaft 146, and a right side of the fourth sleeve 250 is in contact with or abuts a left side of the third impeller 246. A third diffuser 248 is statically held in place by the housing 212 of the centrifugal pump assembly 116, and the fourth sleeve 250 is free to rotate with the drive shaft 146 within a bore defined within the third diffuser 248. The impellers 216, 240, 246 may be said to be configured to do work as the drive shaft 146 rotates, for example performing work on the fluid 142. The sleeves 236, 238, 244, 250 may be referred to in some contexts as spacer sleeves.

A second mechanical shaft stop 222 comprises a second compression stop 254 and a second compression nut 256. Note that in the second mechanical shaft stop 222 the second compression stop 254 is disposed to the right of the second compression nut 256. A collet 232 is disposed between the second compression stop 254 and the second compression nut 256, and the second compression nut 256 urges the collet 232 rightwards into radial compression, causing the collet 232 to establish a friction fit of the second mechanical shaft stop 222 on the drive shaft 146. In an embodiment, the drive shaft 146, the mechanical shaft stops 220, 222, the sleeves 236, 238, 244, 250, and the impellers 216, 240, 246 rotate in a clockwise direction when looking downhole upon these components from an uphole location. In another embodiment, however, the drive shaft 146, the mechanical shaft stops 220, 222, the sleeves 236, 238, 244, 250, and the impellers 216, 240, 246 may rotate in a counterclockwise direction when looking downhole upon these components from an uphole location (in which case the slant angles of the vanes 217, 219 may be flipped about an axis perpendicular to the centerline 147).

The two mechanical shaft stops 220, 222 maintain a compression on the sleeves 236, 238, 244, 250 and the impellers 217, 240, 246 such that the impellers 217, 240, 246 are not allowed to float axially along the drive shaft 146. Any thrust developed by interaction between rotating impellers 217, 240, 246 and the fluid 142 is transferred to the drive shaft 146. In some contexts, the compression nuts 234, 256 may be referred to as compressor flanges. In an embodiment, only the first mechanical shaft stop 220 is employed because the thrust developed on the impellers 216, 240, 246 is directed only to the right (downhole) and thus there is no need to secure the stack of sleeves 236, 238, 244, 250 and impellers 216, 240, 246 against axial motion to the left (uphole). Alternatively, in an embodiment, only the second mechanical shaft stop 222 is employed because the thrust developed on the impellers 216, 240, 246 is directed only to the left (uphole) and thus there is no need to secure the stack of sleeves 236, 238, 244, 250 and impellers 216, 240, 246 against axial motion to the right (downhole).

In an embodiment, one or more bearings may be placed on the drive shaft 146 between the first mechanical shaft stop 220 and the second mechanical shaft stop 222, for example abutted against a sleeve on one side and abutted against an impeller on the other side. In an embodiment, this one or more bearing may take the form of a spider bearing having vanes extending from a central bearing that radially supports the drive shaft 146 to the housing 212 of the centrifugal pump assembly 116. The spider bearing may comprise two vanes, three vanes, four vanes, five vanes, six vanes, seven vanes, eight vanes, or some greater number of vanes less than one hundred vanes. The vanes may be extended in a direction parallel to the centerline 147 and be thin in a direction perpendicular to the centerline 147, whereby the vanes may interfere less with the smooth flow of fluid 142 through the impellers 216, 240, 246 and diffusers 218, 242, 248. In another embodiment, however, a hub of an impeller 216, 240, 246 may extend at least partly into an associated diffuser 218, 242, 248, and the impeller 216, 240, 246 and drive shaft 146 may be radially stabilized by engagement of that hub with the associated diffuser 218, 242, 248. In another embodiment, a bore of the diffusers 218, 242, 248 may provide radial support for the drive shaft 146. In another embodiment, a different structure for radially supporting the drive shaft 146 may be employed.

It will be appreciated that the mechanical shaft stops 220, 222 and the internals (e.g., impellers 216, 240, 246, diffusers 218, 242, 248, and sleeves 236, 238, 244, 250) can be located in other rotating machines in the ESP assembly 106. For example, the mechanical stops 220, 222 and internals described above can be assembled on a drive shaft disposed within a gas separator assembly (see FIG. 5 and FIG. 6 below). For example, the mechanical stops 220, 222 and internals can be assembled on a drive shaft in a charge pump assembly disposed upstream of a gas separator assembly in the ESP assembly 106. In each of these instances, one or both of the mechanical shaft stops 220, 222 can be employed to maintain the impellers of the given assembly in compression and prevent the impellers from floating axially and to transfer thrust from the impellers to the drive shaft.

Figure 4A:
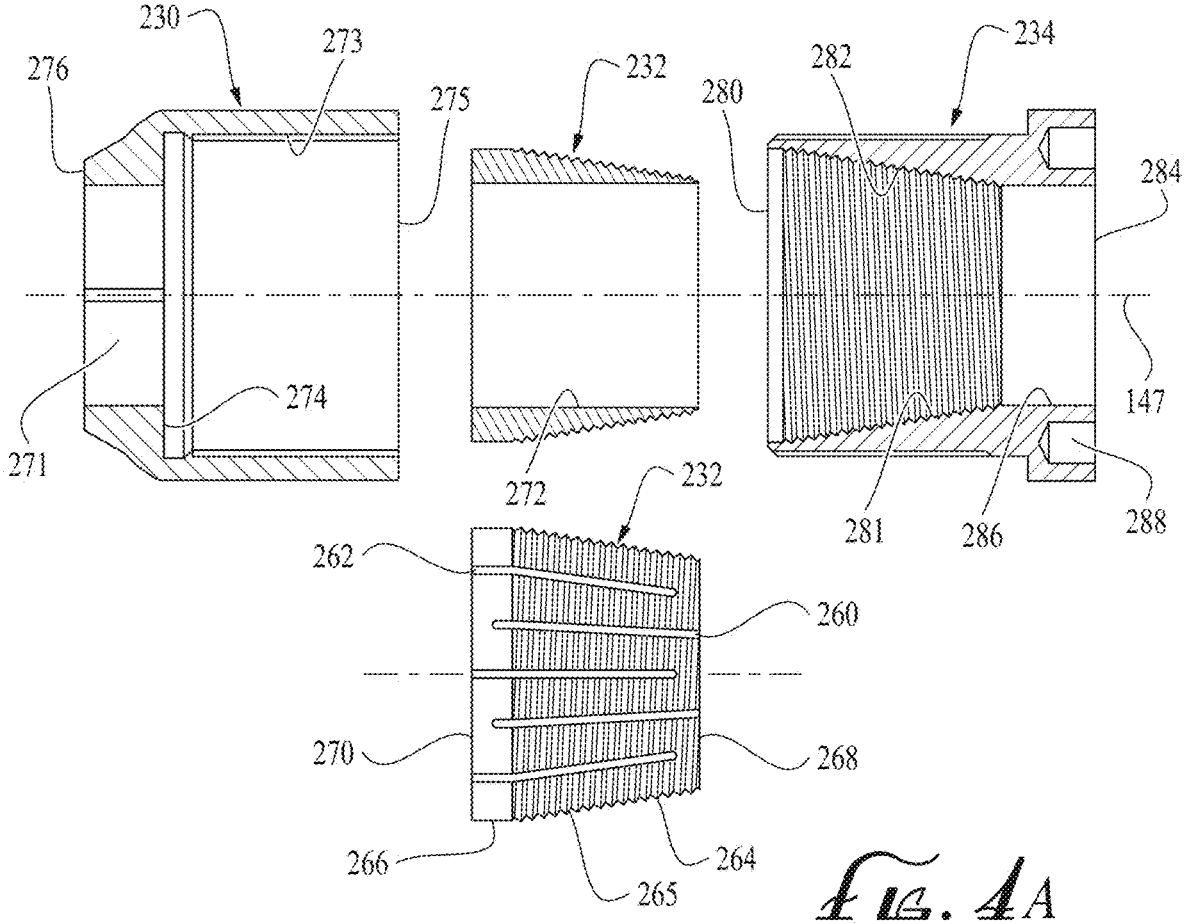
FIG. 4A is an illustration of a first mechanical shaft stop according to an embodiment of the disclosure.

Turning now to FIG. 4A, further details of the mechanical shaft stop 220, 222 are described. The collet 232 has an interior bore 272 that is slightly greater in diameter than the outside diameter of the drive shaft 146. In an embodiment, the interior bore has a diameter of about 0.020 inches greater than the outside diameter (OD) of the drive shaft 146, of about 0.015 inches greater than the OD of the drive shaft 146, of about 0.010 inches greater than the OD of the drive shaft 146, of about 0.008 inches greater than the OD of the drive shaft 146, of about 0.007 inches greater than the OD of the drive shaft 146, of about 0.006 inches greater than the OD of the drive shaft 146, of about 0.005 inches greater than the OD of the drive shaft 146, of about 0.004 inches greater than the OD of the drive shaft 146, of about 0.003 inches greater than the OD of the drive shaft 146, of about 0.002 inches greater than the OD of the drive shaft 146, of about 0.001 inches greater than the OD of the drive shaft 146, of about 0.0008 inches greater than the OD of the drive shaft 146, of about 0.0007 inches greater than the OD of the drive shaft 146, of about 0.0006 inches greater than the OD of the drive shaft 146, or about 0.0005 inches greater than the OD of the drive shaft 146, or about 0.0004 inches greater than the OD of the drive shaft 146. In a preferred embodiment, the interior bore has a diameter of between 0.001 inches greater than the OD of the drive shaft 146 and 0.007 inches greater than the OD of the drive shaft 146. In an embodiment, the clearance between an inside diameter (ID) of the interior bore 272 is desirably sufficiently greater than the OD of the drive shaft 146 that the collet 232 in a relaxed state can be readily slid onto or over the drive shaft 146 while at the same time the ID of the interior bore 272 is small enough (narrow enough) that the collet 232 is not excessively deformed or stressed when urged into engagement with the drive shaft 146 by the compression nut 234.

The collet 232 defines a first plurality of gaps 262 extending from a left end 270 of the collet 232 axially rightwards into an interior of the collet 232 but not through a right end 268 of the collet 232. The collet 232 defines a second plurality of gaps 260 extending from the left end 268 of the collet 232 axially leftwards into an interior of the collet 232 but not through the left end 270 of the collet 232. The gaps 260, 262 enable the collet 232 to elastically deform radially inwards in response to radial compression forces applied to the collet 232 by the compression nut 234. In an embodiment, the collet 232 may be made of spring steel or of another elastic metal material. A righthand portion of the collet 232 defines a conical frustum shape 264, and a lefthand portion of the collet 232 defines a cylindrical shoulder 266. In some contexts, the gaps 260, 262 may be referred to as kerf cuts or slits. In an embodiment, the gaps 260, 262 may be between 0.020 inches wide and 0.150 inches wide. In an embodiment, the gaps 260, 262 may be between 0.030 inches wide and 0.100 inches wide. In an embodiment, the gaps 260, 262 may be between 0.040 inches wide and 0.080 inches wide. In an embodiment, the gaps 260, 262 may be about the width of a saw blade used to cut the gaps 260, 262 into the collet 232. In an embodiment, the collet 232 may have between 6 and 18 gaps 260, 262. In an embodiment, for a larger diameter collet 232 (e.g., where the drive shaft 146 may be larger in diameter), the collet 232 may have between 16 and 24 gaps 260, 262.

The compression stop 230 defines a first interior bore 271, a second interior bore 273, and a shoulder 274 where the first interior bore 271 meets the second interior bore 273. The compression stop 230 has a left side 276 and a right side 275. A lefthand portion of the compression nut 234 defines a conical frustum shaped bore 282 that is configured to mate with the conical frustum shape 264 of the collet 232. A righthand portion of the compression nut 234 defines a cylindrical bore 286. The compression nut 234 has a left side 280 and a right side 284. The right side 284 of the compression nut 234 defines a plurality of receiving bores 288. In an embodiment, the compression stop 230 and the compression nut 234 are made of stainless steel, carbide steel, case hardened steel, or some other metal.

Figure 4B:
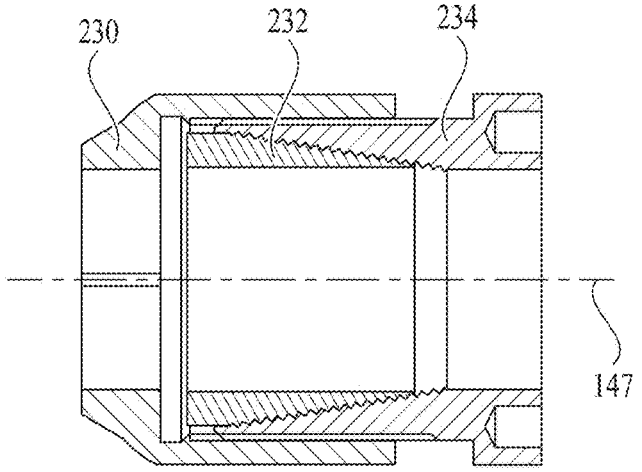
FIG. 4B is an illustration of an assembled state of the mechanical shaft stop according to an embodiment of the disclosure.

In an embodiment, a surface of the conical frustum shape 264 of the collet 232 defines male threads 265, and a surface of the conical frustum bore 282 of the compression nut 234 defines female threads 281. When assembled, the left side 276 of the compression stop 230 may be placed in contact with or abutting structure (e.g., the first sleeve 236 in FIG. 3), the left side 270 of the collet 232 may be inserted into the second bore 273 of the compression stop 230 and in contact with or abutting the interior shoulder 274 of the compression stop 230, the female threads 281 of the compression nut 234 may be threaded onto the male threads 265 of the collet 232, whereby the compression nut 234 compresses the collet 232 and urges the interior bore 272 of the collet 232 to make a friction fit with an outside of the drive shaft 146, thereby axially fixing the mechanical shaft stop 220, 222 to the drive shaft 146. The assembled state of the mechanical stop 220 is illustrated in FIG. 4B.

Figure 4C:
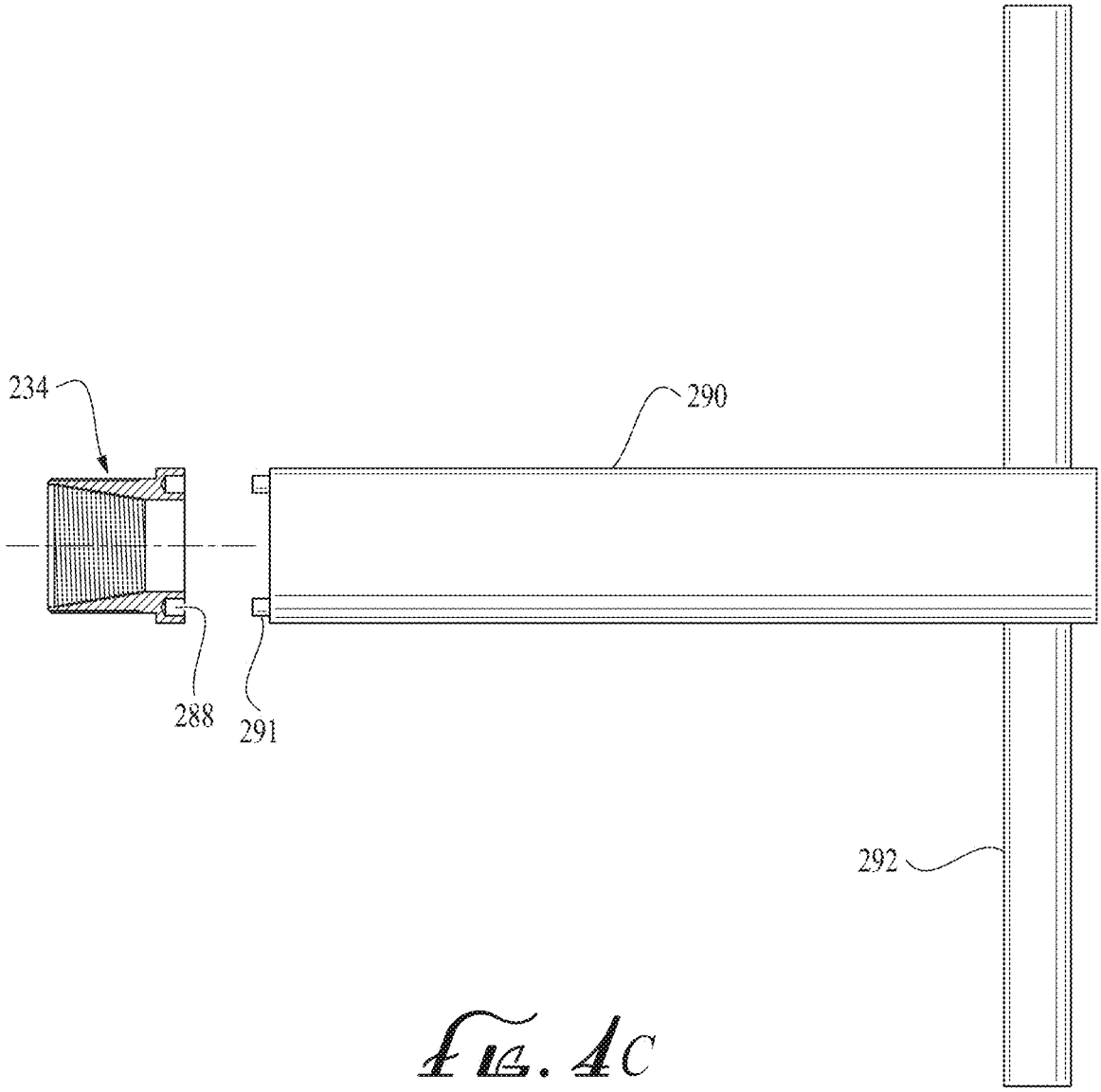
FIG. 4C is an illustration of a tool for assembling a mechanical shaft stop according to an embodiment of the disclosure.

Turning now to FIG. 4C, a spanner wrench 290 for use in screwing the compression nut 234 onto and off of the collet 232 is described. The spanner wrench 290 comprises a handle 292 and a plurality of lugs 291 that are configured to engage with the plurality of receiving bores 288. By inserting the lugs 291 into the receiving bores 288 and turning the handle 292, the compression nut 232 may be rotated about the centerline 147.

Figure 4D:
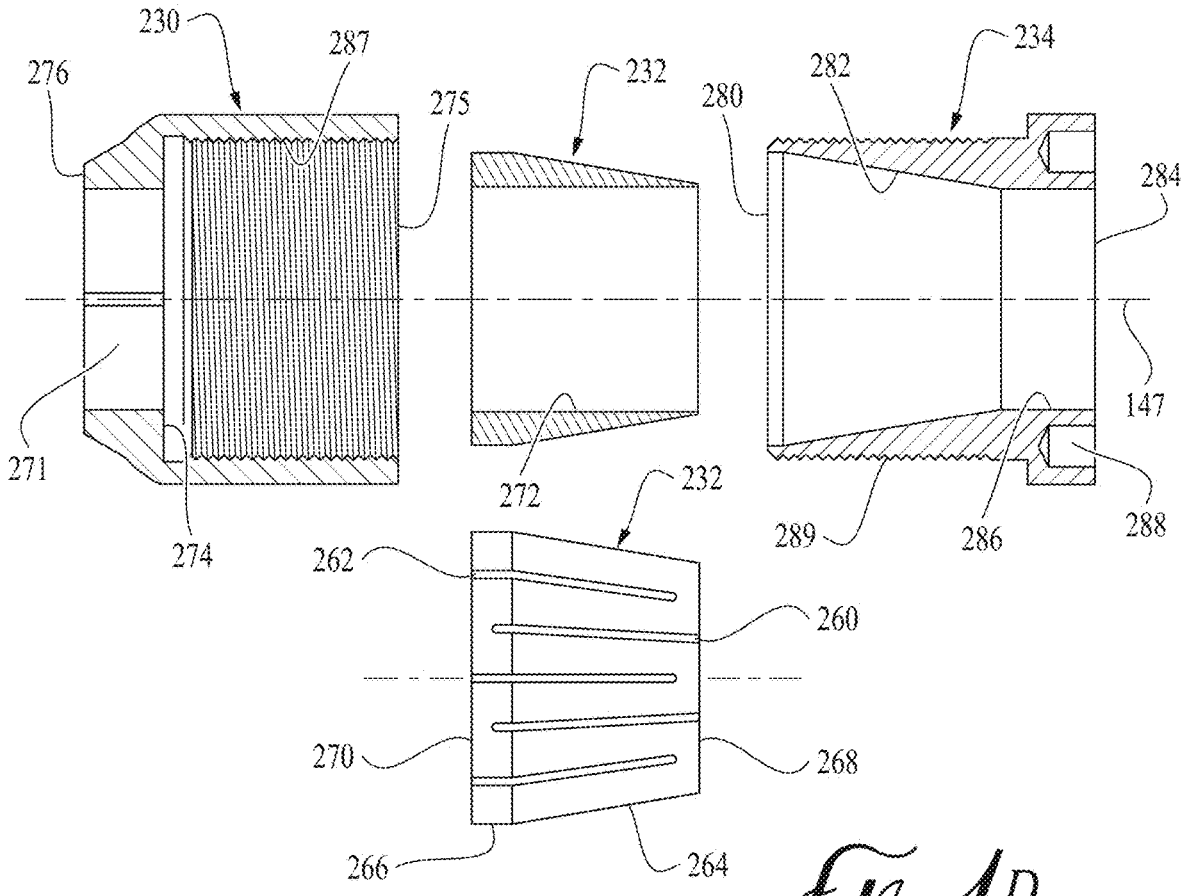
FIG. 4D is an illustration of a second mechanical shaft stop according to an embodiment of the disclosure.
Figure 4E:
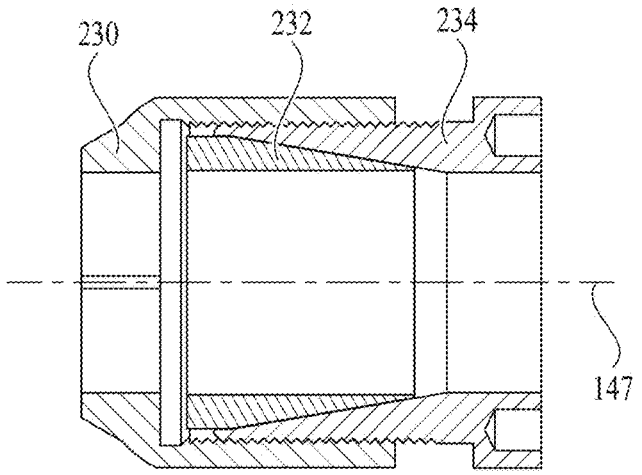
FIG. 4E is an illustration of an assembled state of the second mechanical shaft stop according to an embodiment of the disclosure.

Turning now to FIG. 4D and FIG. 4E, an alternative embodiment of the mechanical stop 220, 222 is described. Here the male threads 265 on the surface of the conical frustum shape 264 of the collet 232 are omitted (relative to FIG. 4A and FIG. 4B), the female threads 281 in the interior bore 282 of the compression nut 234 are omitted (relative to FIG. 4A and FIG. 4B), and instead, as illustrated in FIG. 4D and FIG. 4E, male threads 289 are disposed on an outside of the compression nut 234, and female threads 287 are disposed on the interior of a second bore of the compression stop 230. It will be appreciated that the collet 232 can be compressed by the compression nut 234 by screwing the male threads 289 of the compression nut 234 into the female threads 287 of the compression stop 230 using the spanner wrench 290 to turn the compression nut 234. As the compression nut 234 threads into the compression stop 230, the interior bore 282 of the compression nut 234 slides leftwards over the surface of the conical frustum shape 264 of the collet 232, compressing the collet 232 and urging the interior bore 272 of the collet 232 to engage with the outside of the drive shaft 146, securing the collet 232 by a friction fit to the drive shaft 146 and likewise securing the mechanical stop 220, 222 as a whole. With the exception of the different location of male and female threads, the alternative embodiment of the mechanical stop 220, 222 described with reference to FIG. 4C and FIG. 4D is substantially similar to the embodiment described with reference to FIG. 4A and FIG. 4B.

Figure 4F:
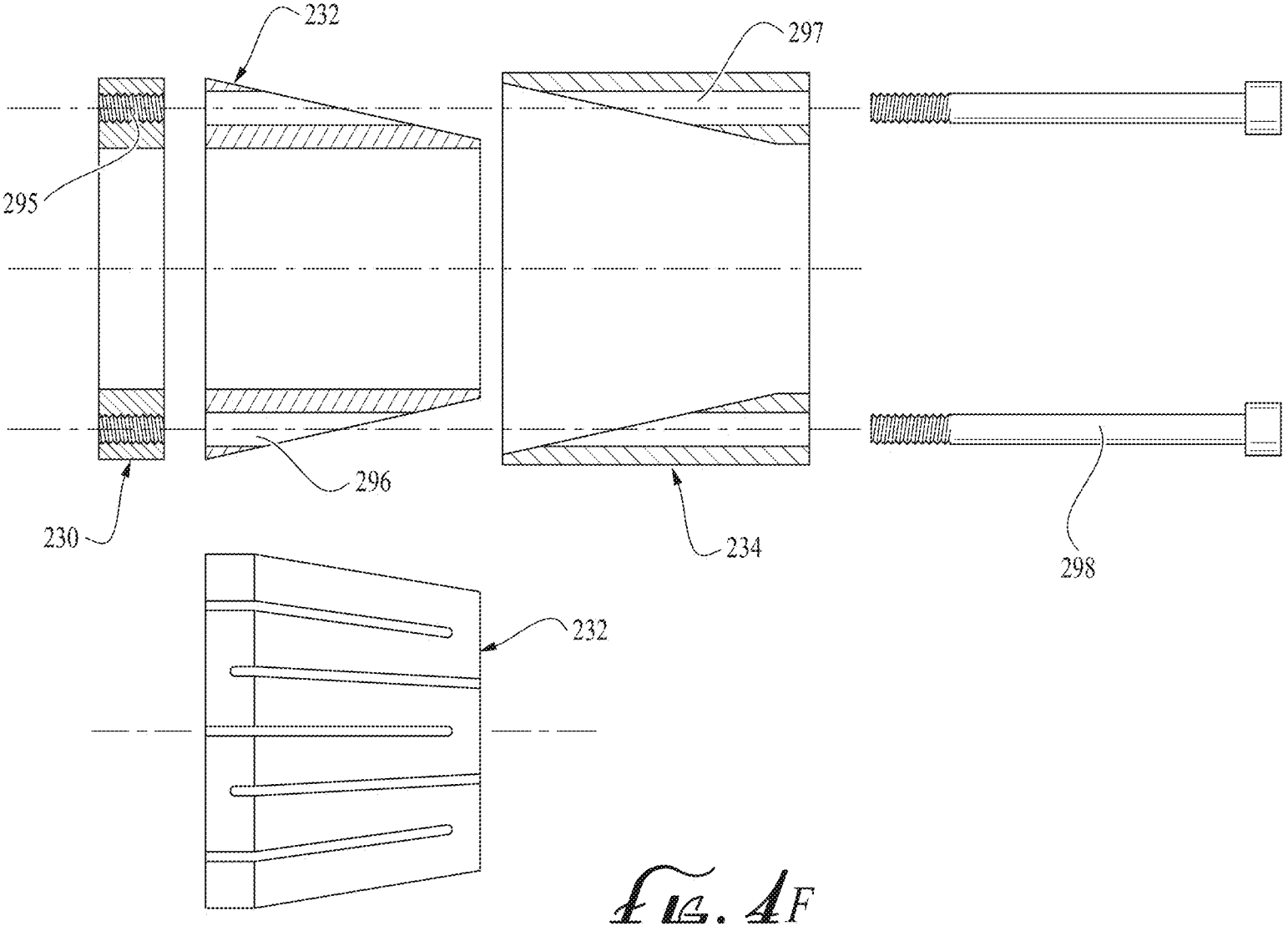
FIG. 4F is an illustration of a second mechanical shaft stop according to an embodiment of the disclosure.

Turning now to FIG. 4F, another alternative embodiment of the mechanical stop 220 is described. In the embodiment of FIG. 4F, the collet 232 does not have male threads 265, and the compression nut 234 does not have female threads 282 urging the compression nut 234 to compress the collet 232. Instead, the compression stop 230 defines a plurality of threaded bores 295, the collet 232 defines a plurality of through holes 296, and the compression nut 234 defines a plurality of through holes 297. A plurality of bolts 298 having male threads at one end are fitted through the through holes 297, through the through holes 296, and are threaded into the female threads defined by the threaded bores 295. By tightening the bolts 298, the compression nut 234 can urge the collet 232 into compression so that it establishes a friction fit with the drive shaft 146.

Figure 5:
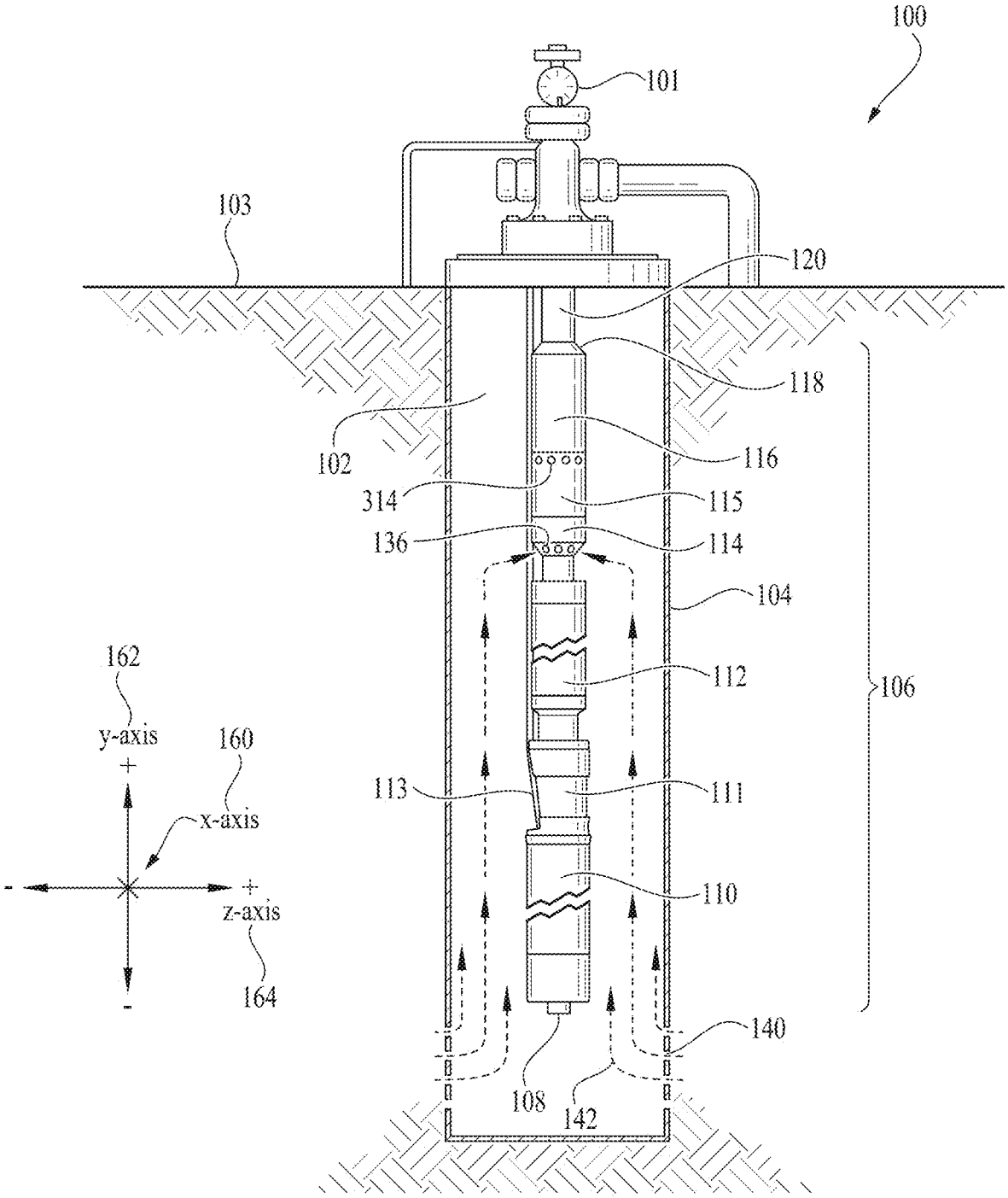
FIG. 5 is an illustration of another electric submersible pump assembly according to an embodiment of the disclosure.

Turning now to FIG. 5, an alternate embodiment of the ESP assembly 106 is described. The well site environment 100 is substantially similar to that illustrated in FIG. 1, with the difference that the ESP assembly 106 comprises a gas separator assembly 115 defining a plurality of gas phase discharge ports 314 disposed at an uphole end of the gas separator assembly 115.

Figure 6:
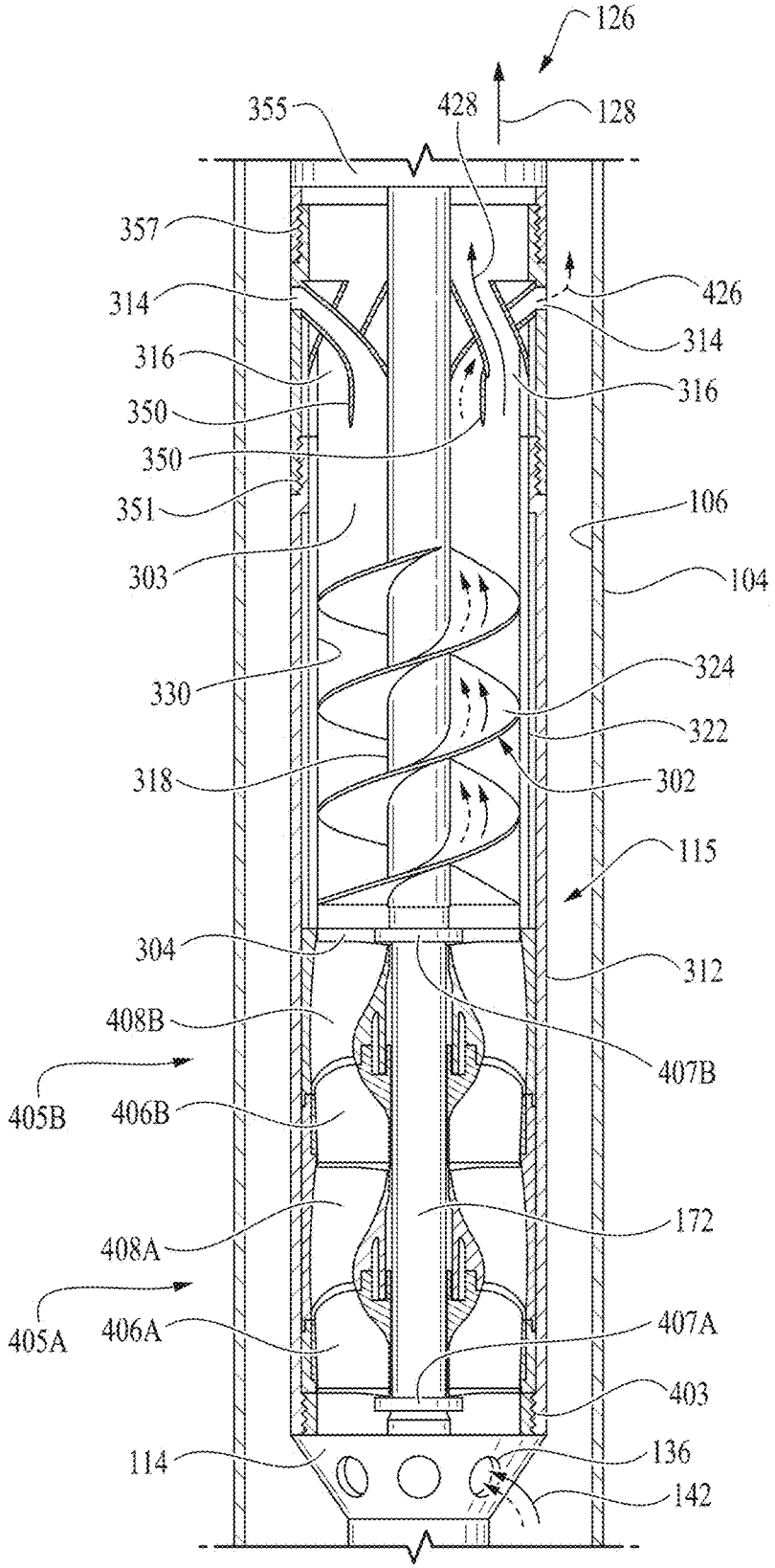
FIG. 6 is an illustration of a gas separator assembly according to an embodiment of the disclosure.

Turning now to FIG. 6, further details of the gas separator assembly 115 are described. A downhole end of the gas separator assembly 115 is coupled to an uphole end of the fluid intake 114. The gas separator assembly 115 comprises a housing 312, a crossover 350, and a head 355. The head 355 may allow for bolting the gas separator assembly 115 to a base of the centrifugal pump assembly 116. The housing 312 may be a cylindrical hollow metal pipe (e.g., a tubular housing). In an embodiment, an inside of the housing 312 may be machined or drilled at one or more locations to create slots or shallow holes for fixing and retaining components within the housing 312, for example diffusers or other components.

In an embodiment, the housing 312 encloses a plurality of centrifugal pump stages 405, for example a first centrifugal pump stage 405A and a second centrifugal pump stage 405B. Each centrifugal pump stage 405 comprises an impeller 406 mechanically coupled to a drive shaft 172 of the gas separator assembly 115 and a diffuser 408 that is retained and held stationary by the housing 312. In an embodiment, the impeller 406 may have a keyway that mates with a keyway in the drive shaft 172 and the keyway of the impeller 406 may be secured to the keyway in the drive shaft 172 by a key. In an embodiment, the impeller 406 may be mechanically coupled to the drive shaft 172 in a different way. When the drive shaft 172 turns, the impeller 406 turns. The first centrifugal pump stage 405A comprises a first impeller 406A and a first diffuser 408A; the second centrifugal pump stage 405B comprises a second impeller 406B and a second diffuser 408B. While two centrifugal pump stages 405A and 405B are illustrated in FIG. 6, in another embodiment, there may be a single centrifugal pump stage 405, three centrifugal pump stages 405, four centrifugal pump stages 405, five centrifugal pump stages 405, six centrifugal pump stages 405, or more centrifugal pump stages 405 located between the base 410 and the fluid reservoir 172. The centrifugal pump stages 405 may be referred to as a first fluid mover in some contexts.

In an embodiment, the centrifugal pump stages 405 are similar to the internal components described above with reference to FIG. 3, for example the impellers 216, 240, 246, the diffusers 218, 242, 248, and the sleeves 236, 238, 244, 250. The centrifugal pump stages can be kept in compression by mechanical shaft stops 407A (corresponding to first mechanical shaft stop 220) and 407B (corresponding to second mechanical shaft stop 222). As described above, the centrifugal pump stages of the gas separator 115 may be axially retained by only one of the mechanical shaft stops 407A or 407B. In an embodiment, the centrifugal pump stages 405 of the gas separator assembly 115 are replaced by another fluid mover mechanism, for example replaced by an auger mechanically coupled to the drive shaft 172, one or more impeller mechanically coupled to the drive shaft 172 (e.g., without a corresponding diffuser), and/or a paddle wheel mechanically coupled to the drive shaft 172. These alternative fluid movers may also be held axially fixed on the drive shaft 172 by the mechanical shaft stops 407A, 407B.

In an embodiment, the drive shaft 172 is mechanically coupled to a drive shaft of the seal unit 112, and the drive shaft of the seal unit 112 is mechanically coupled to a drive shaft of the electric motor 110. Thus, the drive shaft 172 and the impellers 406 (e.g., impellers 406A and 406B in FIG. 2)

of the one or more centrifugal pump stages 405 are turned indirectly by the electric motor 110 when it is energized by electric power via the electric cable 113. The drive shaft 172 is mechanically coupled to the drive shaft 146 of the centrifugal pump assembly 116 and transfers rotational power to the drive shaft of the centrifugal pump assembly 116 and to impellers of the centrifugal pump stages of the centrifugal pump assembly 116. The several different drive shaft mechanical couplings may be provided by splines cut in the mating ends of shafts and coupled by a spline coupler or hub. In another embodiment, the drive shaft mechanical couplings may be provided by other devices.

In an embodiment, the housing 312 also encloses a stationary auger 302. In one or more embodiments, the stationary auger 302 is disposed or positioned within a sleeve 322. The centrifugal pump stages 405 communicates or forces well fluid 142 received at the one or more inlet ports 136 through the stationary auger 302. In an embodiment, an outside edge of the stationary auger 302 engages sealingly with an inside surface 330 of the sleeve 322, and the flow of well fluid 142 through the sleeve 322 is hence confined to the passageway or passageways defined by the stationary auger 302. The sleeve 322 may be disposed or positioned within and retained by the housing 312. In an embodiment, the stationary auger 302 and the sleeve 322 may be built or manufactured as a single component.

In an embodiment, there is no sleeve 322 and the stationary auger 302 is disposed within the inside of the housing 312. The stationary auger 302 may be retained by the inside of the housing 312. In an embodiment, the stationary auger 302 engages sealingly with an inside surface of the housing 312. In an embodiment, there is a space between the outside edges of the stationary auger 302 and the inside surface 330 of the sleeve 332 or a space between the outside edges of the stationary auger 302 and the inside surface of the housing 312.

In one or more embodiments, the stationary auger 302 comprises one or more helixes or vanes 324. In one or more embodiments, the helixes or vanes 324 may be crescent-shaped. In one or more embodiments, the stationary auger 302 comprises one or more helixes or vanes 324 disposed about a solid core, for example shaft 318 that encloses the drive shaft 172, or an open core (for example, a coreless auger or an auger flighting). The stationary auger 302 may cause the well fluid 142 to be separated into a liquid phase 308 and gas phase 306 based, at least in part, on rotational flow of the well fluid 142.

For example, the one or more helixes or vanes 324 may impart rotation to the well fluid 142 as the well fluid 142 flows through, across or about the one or more helixes or vanes 324. The stationary auger 302, then, can be referred to as a fluid mover at least because it imparts a rotating motion to the well fluid 142 as the well fluid 142 flows through the stationary auger 302. For example, fluid mover 310 forces the well fluid 142 at a velocity or flow rate into the sleeve 322 and up or across the one or more helixes or vanes 324 of stationary auger 302. The rotation of the well fluid 142 induced by the stationary auger 302 may be based, at least in part, on the velocity or flow rate of the well fluid 142 generated by the centrifugal pump stages 405. For example, the centrifugal pump stages 405 may increase the flow rate or velocity of the well fluid 142 to increase rotation of the well fluid 142 through the stationary auger 302 to create a more efficient and effective separation of the well fluid 142 into a plurality of phases, for example, a liquid phase fluid 428 and a gas phase fluid 426. As the well fluid 142 flows through the stationary auger 302, centrifugal forces, static friction or both, cause the heavier component of the well fluid 142, a liquid phase fluid 428, to circulate along an outer perimeter of the stationary auger 302 while the lighter component of the well fluid 142, the gas phase fluid 426, is circulated along an inner perimeter of the stationary auger 302. In one or more embodiments, well fluid 142 may begin to separate while flowing through stationary auger 302. In one or more embodiments, the liquid phase fluid 428 may comprise residual gas that did not separate into the gas phase fluid 426. However, the embodiments discussed herein reduce this residual gas to protect the centrifugal pump assembly 116 from gas build-up or gas lock.

In an embodiment, the stationary auger 302 is not present and instead a different kind of second fluid mover is provided. The second fluid mover may be provided by an auger mechanically coupled to the drive shaft 172, a paddle wheel mechanically coupled to the drive shaft 172, a centrifuge rotor mechanically coupled to the drive shaft 172, or an impeller mechanically coupled to the drive shaft 172 that induce rotating motion of the well fluid 142. In an embodiment, a third fluid mover is provided downstream of the stationary auger 302, for example a paddle wheel may be installed downstream of the stationary auger 172 that induces and/or increases rotating motion of the well fluid 142.

A separation chamber 303 is provided downstream of the second fluid mover (e.g., the stationary auger 302) and downstream of the optional third fluid mover. An upstream end of the separation chamber 303 is fluidically coupled to a downstream end or an outlet of the stationary auger 302 or other second fluid mover. Alternatively, the upstream end of the separation chamber 303 is fluidically coupled to a downstream end or an outlet of the optional third fluid mover and is fluidically coupled to the third fluid mover and, via the third fluid mover, fluidically coupled to the second fluid mover. The separation chamber 303 is defined by an annulus formed between the inside of the housing 312 and the outside of the drive shaft 172. In an embodiment, the separation chamber is less than 36 inches long and at least 4 inches long, at least 6 inches long, at least 8 inches long, at least 10 inches long, at least 12 inches long, or at least 14 inches long. In an embodiment, the separation chamber is at least 6 inches long and less than 17 inches long. The stationary auger 302 (or other second fluid mover and/or third fluid mover) induces a rotating motion in the well fluid 142. As the well fluid 142 exits the stationary auger 302 (or other second fluid mover and/or third fluid mover) and enters the separation chamber 303, this rotating motion of the well fluid 142 continues. The rotating motion of the well fluid 142 within the separation chamber 303 induces gas phase fluid (which is less dense than the liquid phase fluid) to concentrate near the drive shaft 172 and the liquid phase fluid to concentrate near the inside surface of the housing 312.

In one or more embodiments, the separated fluids (for example, liquid phase fluid 428 and gas phase fluid 426) are directed to a crossover 350. For example, the crossover 350 may be disposed or positioned at a downstream end of the separation chamber 303 or housing 312. In some contexts, the crossover 350 may be referred to as a gas flow path and liquid flow path separator. The crossover 350 may comprise a plurality of channels or define a plurality of channels, for example, a gas phase discharge 314 (a first pathway) and a liquid phase discharge 316 (a second pathway). A gas phase fluid 426 of the well fluid 142 may be discharged through the gas phase discharge 314, out the gas phase discharge ports 138, and a liquid phase fluid 428 of the well fluid 142 may be discharged through the liquid phase discharge 316.

In one or more embodiments, any one or more of the gas phase discharge ports 314 and the one or more liquid phase discharge ports 316 may be defined by a channel or pathway having an opening, for example, a teardrop shaped opening, a round opening, an elliptical opening, a triangular opening, a square opening, or another shaped opening. The crossover 350 may be threadingly coupled at an upstream end by threaded coupling 351 to a downstream end of the housing 312. The crossover 350 may be threadingly coupled at a downstream end by threaded coupling 357 to a head 355. Alternatively, the head 355 may be integrated with the head 355 rather than threadingly coupled to the head 355. The head 355 may provide bolt holes for coupling to an upstream end of the centrifugal pump assembly 116. In some contexts, the crossover 350 may be said to be mechanically coupled at an upstream end to a downstream end of the housing 312. When the crossover 350 and the head 355 are not integrated as a single component, the crossover 350 may be said to be mechanically coupled at a downstream end to an upstream end of the head 355. In an embodiment, two or more instances of gas separator assemblies 115 are connected in series, such that the drive shafts of each adjacent gas separator assembly 115 couples to the corresponding adjacent gas separator assembly 115, and wherein the liquid phase discharge 316 of the adjacent downhole gas separator assembly 115 feeds into the fluid inlet of the adjacent uphole gas separator assembly 115.

Figure 7:
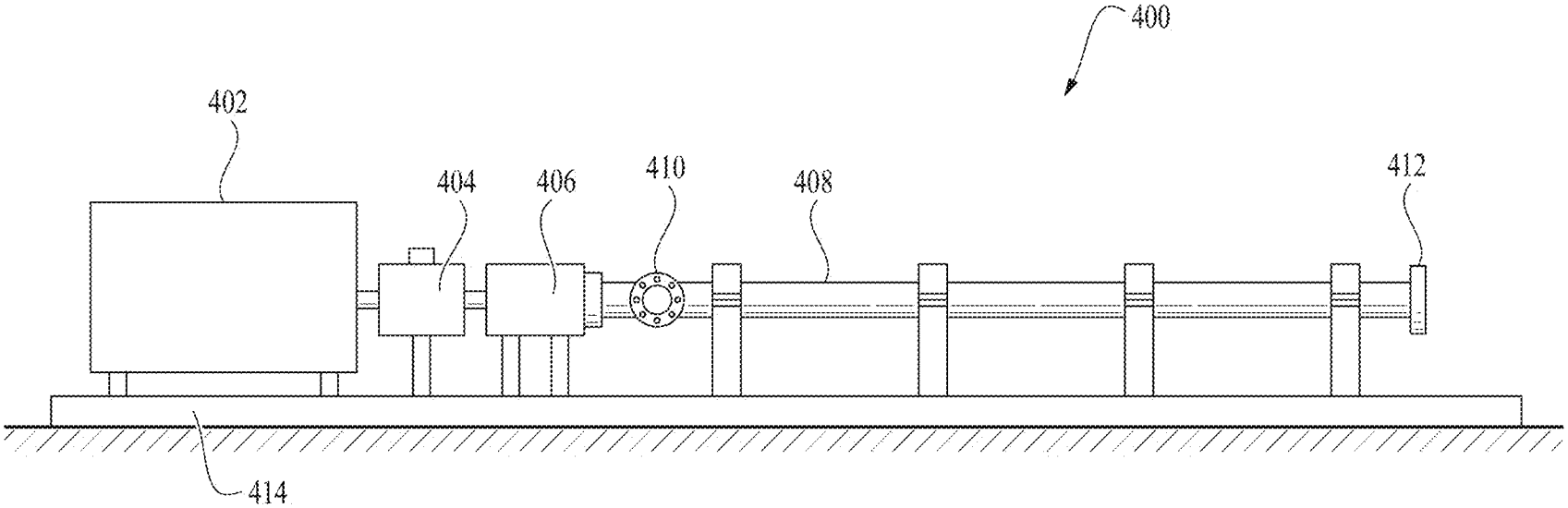
FIG. 7 is an illustration of a horizontal pump system according to an embodiment of the disclosure.

Turning now to FIG. 7, a horizontal pumping system (HPS) 400 is described. In an embodiment, the HPS 400 comprises a motor 402, a rotational coupling 404, a mechanical seal 406, and a centrifugal pump assembly 408. In an embodiment, a fluid inlet 410 is integrated into a first end of the centrifugal pump assembly 408 and a fluid outlet 412 may be integrated into a second end of the centrifugal pump assembly 408. The motor 402, the rotational coupling 404, the mechanical seal 406, and the centrifugal pump assembly 408 may be mounted on a skid 414 such that it can be easily transported to a location on a truck and placed on the ground at the location. The centrifugal pump assembly 408 is substantially similar to the centrifugal pump assembly 116 described above with reference to FIG. 2, FIG. 3, FIG. 4A, FIG. 4B, FIG. 4C, and FIG. 4D. For example, the centrifugal pump assembly 408 comprises a plurality of pump stages 214 with an impeller 216 and a diffuser 218 and one or more sleeves as described above, where each pump stage comprises the impeller 216 coupled to a drive shaft of the centrifugal pump assembly 408 and the diffuser 218 that is retained by a housing (e.g., a tubular housing) of the centrifugal pump assembly 408. In an embodiment, the centrifugal pump assembly 408 comprises from one to four hundred pump stages 214.

The motor 402 may be an electric motor, a hydraulic turbine, or an air turbine. When the motor 402 turns, the drive shaft of the centrifugal pump assembly 408 turns, turning the impellers of the centrifugal pump assembly 408. The torque provided by the motor 402 is transferred via the rotational coupling 404 to the drive shaft of the centrifugal pump assembly 408.

The HPS 400 may be applied for use in a variety of different surface operations. The HPS 400 can be used as a crude oil pipeline pressure and/or flow booster. The HPS 400 can be used in a mine dewatering operation (e.g., removing water from a mine). The HPS 400 can be used in geothermal energy applications, for example to pump geothermal water from a wellhead through a pipe to an end-use or energy conversion facility. The HPS 400 can be used in carbon sequestration operations. The HPS 400 can be used in salt water disposal operations, for example receiving salt water from a wellbore and pumping the salt water under pressure down into a disposal well. The HPS 400 can be used in desalinization operations. In any of these surface pumping applications, the novel diffuser structures taught above can advantageously be applied to increase the efficiency of the centrifugal pump assembly 408, to increase the head and/or flow rate produced by the centrifugal pump assembly 408, and/or increase the service life of the centrifugal pump assembly. In some contexts, the HPS 400

Figure 8:
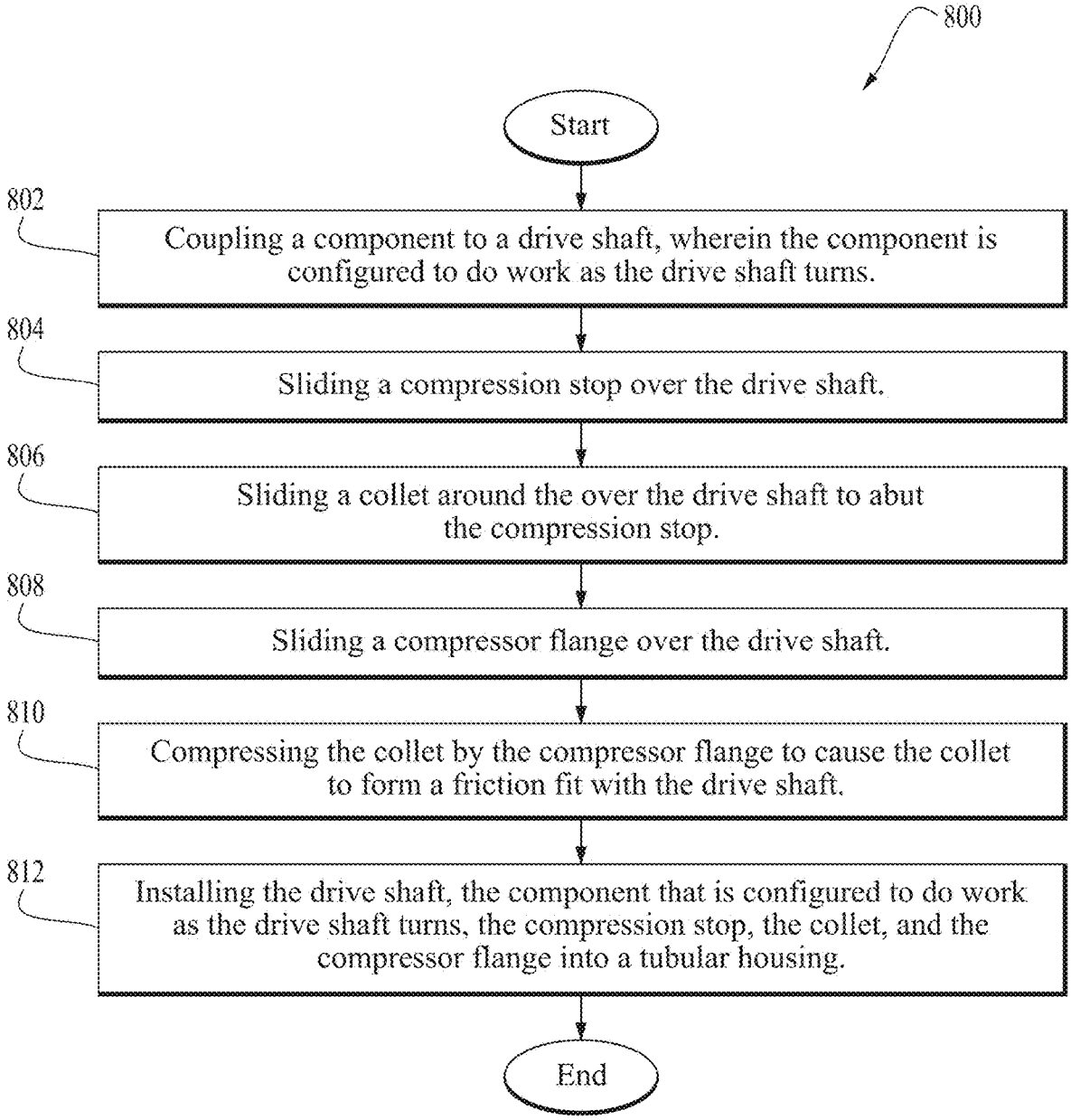
FIG. 8 is a flow chart of a method according to an embodiment of the disclosure.

Turning now to FIG. 8, a method 800 is described. In an embodiment, the method 800 comprises a method of assembling a rotating machine. In an embodiment, the rotating machine is at least a part of a centrifugal pump assembly. In an embodiment, the rotating machine is part of a gas separator assembly. In an embodiment, the rotating machine is at least a part of a charge pump assembly. In an embodiment, the rotating machine is at least a part of an HPS. At block 802, the method 800 comprises coupling a component to a drive shaft, wherein the component is configured to do work as the drive shaft turns. In an embodiment, the component that is configured to do work as the drive shaft turns is one or more impellers. In an embodiment, the component that is configured to work as the drive shaft turns is a rotating auger. In an embodiment, the component that is configured to do work as the drive shaft turns is a paddlewheel. At block 804, the method 800 comprises sliding a compression stop over the drive shaft.

At block 806, the method 800 comprises sliding a collet over the drive shaft to abut the compression stop. In an embodiment, the collet comprises spring steel. In an embodiment, the collet defines a plurality of gaps. In an embodiment, the collet defines a plurality of kerf cuts. At block 808, the method 800 comprises sliding a compressor flange over the drive shaft.

At block 810, the method 800 comprises compressing the collet by the compressor flange to cause the collet to form a friction fit with the drive shaft. In an embodiment, an outside surface of the collet defines a conical frustum shape where it engages with an interior of the compressor flange. At block 812, the method 800 comprises installing the drive shaft, the component that is configured to do work as the drive shaft turns, the compression stop, the collet, and the compressor flange into a tubular housing. In an embodiment, the method 800 further comprises sliding a sleeve over the drive shaft, sliding a diffuser over the sleeve, wherein installing the drive shaft, the component that is configured to work as the drive shaft turns, the compression stop, the collet, and the compressor flange into the tubular housing further comprises installing the sleeve and the diffuser into the housing.

Figure 9:
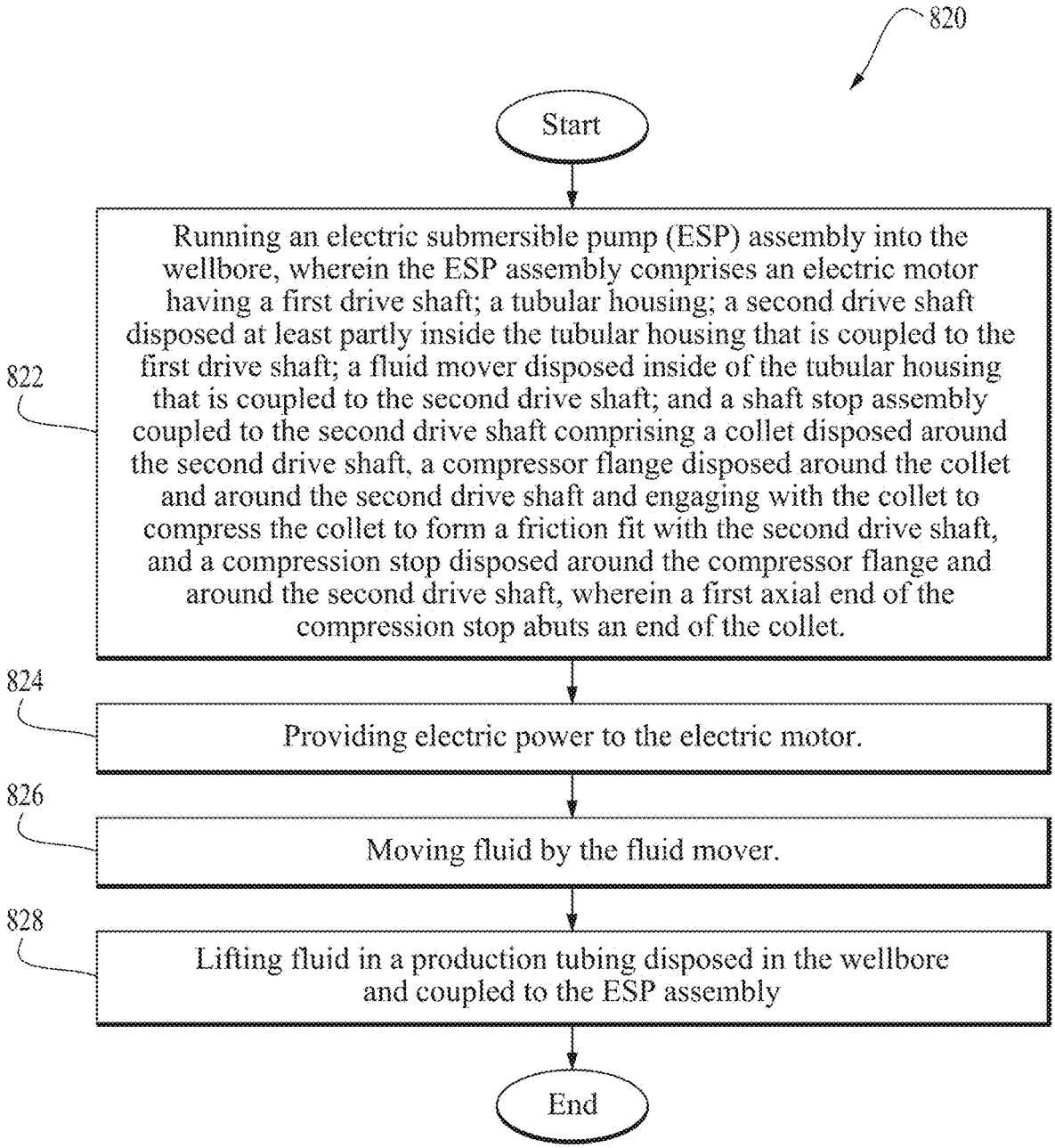
FIG. 9 is a flow chart of another method according to an embodiment of the disclosure.

Turning now to FIG. 9, a method 820 is described. In an embodiment, the method 820 comprises a method of lifting fluid in a wellbore. At block 822, the method 820 comprises running an electric submersible pump (ESP) assembly into the wellbore, wherein the ESP assembly comprises an electric motor having a first drive shaft; a tubular housing; a second drive shaft disposed at least partly inside the tubular housing that is coupled to the first drive shaft; a fluid mover disposed inside of the tubular housing that is coupled to the second drive shaft; and a shaft stop assembly coupled to the second drive shaft comprising a collet disposed around the second drive shaft, a compressor flange disposed around the collet and around the second drive shaft and engaging with the collet to compress the collet to form a friction fit with the second drive shaft, and a compression stop disposed around the compressor flange and around the second drive shaft, wherein a first axial end of the compression stop abuts an end of the collet. In an embodiment, the fluid mover comprises a plurality of impellers that are axially located by the shaft stop assembly. In an embodiment, the fluid mover comprises a plurality of impellers that are axially fixed to the second drive shaft by the shaft stop assembly. In an embodiment, the fluid mover comprises a plurality of sleeves coupled to the second drive shaft, wherein each sleeve abuts impellers adjacent to the sleeve to transfer thrust from the impellers to the shaft stop assembly. In an embodiment, the collet is made of spring steel.

At block 824, the method 820 comprises providing electric power to the electric motor. At block 826, the method 820 comprises moving fluid by the fluid mover. In an embodiment, the method 820 further comprises transferring thrust from the fluid mover to the second drive shaft via the shaft stop assembly. At block 828, the method 820 comprises lifting fluid in a production tubing disposed in the wellbore and coupled to the ESP assembly.

Figure 10:
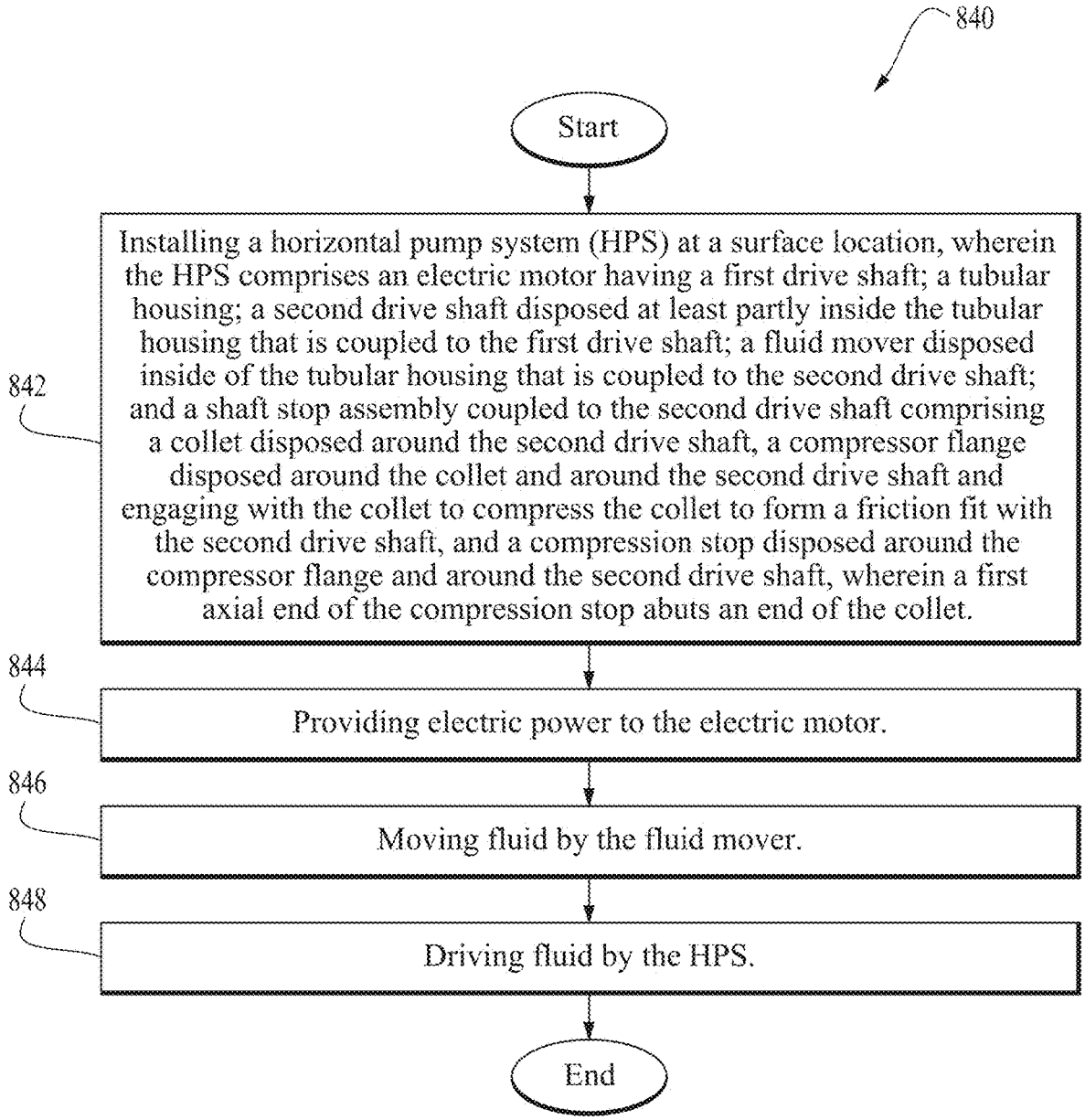
FIG. 10 is a flow chart of yet another method according to an embodiment of the disclosure.

Turning now to FIG. 10, a method 840 is described. In an embodiment, the method 840 is a method of moving fluid by a horizontal pump system (HPS). At block 842, the method 840 comprises installing a horizontal pump system HPS at a surface location, wherein the HPS comprises an electric motor having a first drive shaft; a tubular housing; a second drive shaft disposed at least partly inside the tubular housing that is coupled to the first drive shaft; a fluid mover disposed inside of the tubular housing that is coupled to the second drive shaft; and a shaft stop assembly coupled to the second drive shaft comprising a collet disposed around the second drive shaft, a compressor flange disposed around the collet and around the second drive shaft and engaging with the collet to compress the collet to form a friction fit with the second drive shaft, and a compression stop disposed around the compressor flange and around the second drive shaft, wherein a first axial end of the compression stop abuts an end of the collet.

At block 844, the method 840 comprises providing electric power to the electric motor. At block 846, the method 840 comprises moving fluid by the fluid mover. At block 848, the method 840 comprises driving fluid by the HPS

Additional Embodiments

The following are non-limiting, specific embodiments in accordance with the present disclosure:

A first embodiment, which is a rotating machine comprising a tubular housing; a drive shaft disposed at least partly inside the tubular housing; a component disposed inside of the tubular housing that is coupled to the drive shaft and configured to do work as the drive shaft rotates; and a shaft stop assembly coupled to the drive shaft comprising a collet disposed around the drive shaft, a compressor flange disposed around the collet and around the drive shaft and engaging with the collet to compress the collet to form a friction fit with the drive shaft, and a compression stop disposed around the compressor flange and around the drive shaft, wherein a first axial end of the compression stop abuts an end of the collet.

A second embodiment, which is the rotating machine of the first embodiment, wherein a second axial end of the compression stop (A) abuts the component that is coupled to the drive shaft and configured to do work as the drive shaft rotates or (B) abuts a sleeve disposed around the drive shaft and coupled to the drive shaft, wherein the sleeve abuts the component that is coupled to the drive shaft and configured to do work as the drive shaft rotates.

A third embodiment, which is the rotating machine of either of the first or the second embodiment, wherein the component disposed inside of the tubular housing comprises an impeller.

A fourth embodiment, which is the rotating machine of any of the first through the third embodiment, wherein the rotating machine is a component of an electric submersible pump (ESP) assembly.

A fifth embodiment, which is the rotating machine of any of the first through the fourth embodiment, wherein the rotating machine is at least a part of a centrifugal pump assembly.

A sixth embodiment, which is the rotating machine of any of the first through the fourth embodiment, wherein the rotating machine is at least a part of a gas separator assembly.

A seventh embodiment, which is the rotating machine of any of the first through the fourth embodiment, wherein the rotating machine comprises both at least part of a centrifugal pump assembly and at least part of a gas separator assembly.

An eighth embodiment, which is the rotating machine of any of the first through the third embodiment, wherein the rotating machine is at least a part of a horizontal pump system (HPS).

A ninth embodiment, which is the rotating machine of any of the first through the eighth embodiment, wherein the collet comprises a plurality of gaps.

A tenth embodiment, which is the rotating machine of any of the first through the ninth embodiment, wherein a surface of the collet defines male threads, and wherein an interior bore of the compressor flange defines female threads that mate with the male threads of the collet to compress the collet to form the friction fit with the drive shaft.

An eleventh embodiment, which is the rotating machine of any of the first through the ninth embodiment, wherein the compression stop comprises a plurality of female threaded bores, wherein the collet defines a plurality of through bores, wherein the compressor flange defines a plurality of through bores, wherein the shaft stop assembly further comprises a plurality of bolts having male threads, and wherein the plurality of bolts are threaded into the female threaded bores of the compression stop to compress the collet to form the friction fit with the drive shaft.

A twelfth embodiment, which is a method of assembling a rotating machine according to any of the first through the eleventh embodiment, comprising coupling a component to a drive shaft, wherein the component is configured to do work as the drive shaft turns; sliding a compression stop over the drive shaft; sliding a collet around the over the drive shaft to abut the compression stop; sliding a compressor flange over the drive shaft; compressing the collet by the compressor flange to cause the collet to form a friction fit with the drive shaft; and installing the drive shaft, the component that is configured to do work as the drive shaft turns, the compression stop, the collet, and the compressor flange into a tubular housing.

A thirteenth embodiment, which is a method of assembling a rotating machine comprising coupling a component to a drive shaft, wherein the component is configured to do work as the drive shaft turns; sliding a compression stop over the drive shaft; sliding a collet around the over the drive shaft to abut the compression stop; sliding a compressor flange over the drive shaft; compressing the collet by the compressor flange to cause the collet to form a friction fit with the drive shaft; and installing the drive shaft, the component that is configured to do work as the drive shaft turns, the compression stop, the collet, and the compressor flange into a tubular housing.

A fourteenth embodiment, which is the method of the thirteenth embodiment, wherein the component that is configured to do work as the drive shaft turns is an impeller.

A fifteenth embodiment, which is the method of the fourteenth embodiment, further comprising sliding a sleeve over the drive shaft, sliding a diffuser over the sleeve, wherein installing the drive shaft, the component that is configured to work as the drive shaft turns, the compression stop, the collet, and the compressor flange into the tubular housing further comprises installing the sleeve and the diffuser into the housing.

A sixteenth embodiment, which is the method of any of the thirteenth through the fifteenth embodiment, wherein the collet comprises spring steel.

A seventeenth embodiment, which is the method of any of the thirteenth through the sixteenth embodiment, wherein an outside surface of the collet defines a conical frustum shape where it engages with an interior of the compressor flange.

An eighteenth embodiment, which is a method of lifting fluid in a wellbore comprising running an electric submersible pump (ESP) assembly into the wellbore, wherein the ESP assembly comprises an electric motor having a first drive shaft; a tubular housing; a second drive shaft disposed at least partly inside the tubular housing that is coupled to the first drive shaft; a fluid mover disposed inside of the tubular housing that is coupled to the second drive shaft; and a shaft stop assembly coupled to the second drive shaft comprising a collet disposed around the second drive shaft, a compressor flange disposed around the collet and around the second drive shaft and engaging with the collet to compress the collet to form a friction fit with the second drive shaft, and a compression stop disposed around the compressor flange and around the second drive shaft, wherein a first axial end of the compression stop abuts an end of the collet; providing electric power to the electric motor; moving fluid by the fluid mover; and lifting fluid in a production tubing disposed in the wellbore and coupled to the ESP assembly.

A nineteenth embodiment, which is the method of the eighteenth embodiment, wherein the tubular housing, the second drive shaft, the fluid mover, and the shaft stop assembly is part of a centrifugal pump assembly.

A twentieth embodiment, which is the method of the eighteenth embodiment, wherein the tubular housing, the second drive shaft, the fluid mover, and the shaft stop assembly is part of a gas separator assembly.

A twenty-first embodiment, which is the method of any of the eighteenth through the twentieth embodiment, wherein the collet comprises a plurality of gaps.

A twenty-second embodiment, which is the method of any of the eighteenth through the twenty-first embodiment, wherein the collet comprises spring steel.

A twenty-third embodiment, which is the method of any of the eighteenth through the twenty-second embodiment, wherein a surface of the collet defines male threads, and wherein an interior bore of the compressor flange defines female threads that mate with the male threads of the collet to compress the collet to form the friction fit with the second drive shaft.

A twenty-fourth embodiment, which is the method of any of the eighteenth through the twenty-second embodiment, wherein the compression stop comprises a plurality of female threaded bores, wherein the collet defines a plurality of through bores, wherein the compressor flange defines a plurality of through bores, wherein the shaft stop assembly further comprises a plurality of bolts having male threads, and wherein the plurality of bolts are threaded into the female threaded bores of the compression stop to compress the collet to form the friction fit with the second drive shaft.

A twenty-fifth embodiment, which is the method of any of the eighteenth through the twenty-fourth embodiment, further comprising transferring thrust from the fluid mover to the second drive shaft via the shaft stop assembly.

A twenty-sixth embodiment, which is the method of the eighteenth through the twenty-fifth embodiment, wherein the fluid mover comprises a plurality of impellers that are axially located by the shaft stop assembly.

A twenty-seventh embodiment, which is the method of the twenty-sixth embodiment, wherein the fluid mover comprises a plurality of sleeves coupled to the second drive shaft, wherein each sleeve abuts impellers adjacent to the sleeve to transfer thrust from the impellers to the shaft stop assembly.

A twenty-eighth embodiment, which is a method of moving fluid by a horizontal pump system (HPS) comprising installing the horizontal pump system HPS at a surface location, wherein the HPS comprises an electric motor having a first drive shaft; a tubular housing; a second drive shaft disposed at least partly inside the tubular housing that is coupled to the first drive shaft; a fluid mover disposed inside of the tubular housing that is coupled to the second drive shaft; and a shaft stop assembly coupled to the second drive shaft comprising a collet disposed around the second drive shaft, a compressor flange disposed around the collet and around the second drive shaft and engaging with the collet to compress the collet to form a friction fit with the second drive shaft, and a compression stop disposed around the compressor flange and around the second drive shaft, wherein a first axial end of the compression stop abuts an end of the collet.

A twenty-ninth embodiment, which is the method of the twenty-eighth embodiment, wherein the collet comprises spring steel.

A thirtieth embodiment, which is the method of any of the twenty-eighth or the twenty-ninth embodiment, wherein the collet comprises a plurality of gaps.

A thirty-first embodiment, which is the method of any of the twenty-eighth through the thirtieth embodiment, wherein a surface of the collet defines male threads, and wherein an interior bore of the compressor flange defines female threads that mate with the male threads of the collet to compress the collet to form the friction fit with the second drive shaft.

A thirty-second embodiment, which is the method of any of the twenty-eighth through the thirtieth embodiment, wherein the compression stop comprises a plurality of female threaded bores, wherein the collet defines a plurality of through bores, wherein the compressor flange defines a plurality of through bores, wherein the shaft stop assembly further comprises a plurality of bolts having male threads, and wherein the plurality of bolts are threaded into the female threaded bores of the compression stop to compress the collet to form the friction fit with the second drive shaft.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A rotating machine, comprising:

a tubular housing;

a drive shaft disposed at least partly inside the tubular housing;

a component disposed inside of the tubular housing that is coupled to the drive shaft and configured to do work as the drive shaft rotates; and a shaft stop assembly coupled to the drive shaft comprising a collet disposed around the drive shaft, wherein the collet defines a plurality of through bores, a compressor flange disposed around the collet and around the drive shaft and engaging with the collet to compress the collet to form a friction fit with the drive shaft, wherein the compressor flange defines a plurality of through bores, a compression stop disposed around the compressor flange and around the drive shaft, wherein a first axial end of the compression stop abuts an end of the collet and wherein the compression stop defines a plurality of female threaded bores, and a plurality of bolts having male threads, wherein the plurality of bolts are threaded into the female threaded bores of the compression stop to compress the collet to form the friction fit with the drive shaft.

2. The rotating machine of claim 1, wherein a second axial end of the compression stop (A) abuts the component that is coupled to the drive shaft and configured to do work as the drive shaft rotates or (B) abuts a sleeve disposed around the drive shaft and coupled to the drive shaft, wherein the sleeve abuts the component that is coupled to the drive shaft and configured to do work as the drive shaft rotates.

3. The rotating machine of claim 1, wherein the component disposed inside of the tubular housing comprises an impeller.

4. The rotating machine of claim 1, wherein the collet comprises a plurality of gaps, wherein at least some of the plurality of gaps are disposed at a first axial end of the collet and at least some of the plurality of gaps are disposed at a second axial end of the collet.

5. A method of assembling a rotating machine, comprising:

coupling a component to a drive shaft, wherein the component is configured to do work as the drive shaft turns;

sliding a compression stop that defines a plurality of female threaded bores over the drive shaft;

sliding a collet over the drive shaft to abut the compression stop, wherein the collet defines a plurality of through bores;

sliding a compressor flange that defines a plurality of through bores over the drive shaft;

installing a plurality of bolts having male threads into the through bores of the compressor flange and threading the plurality of bolts into the female threaded bores of the compression stop;

tightening the plurality of bolts to move the compressor flange to urge the collet into compression to establish a friction fit between the collet and the drive shaft;

and installing the drive shaft, the component that is configured to do work as the drive shaft turns, the compression stop, the collet, and the compressor flange into a tubular housing.

6. The method of claim 5, wherein the component that is configured to do work as the drive shaft turns is an impeller.

7. The method of claim 6, further comprising sliding a sleeve over the drive shaft, sliding a diffuser over the sleeve, wherein installing the drive shaft, the component that is configured to work as the drive shaft turns, the compression stop, the collet, and the compressor flange into the tubular housing further comprises installing the sleeve and the diffuser into the housing.

8. The method of claim 5, wherein an outside surface of the collet defines a conical frustum shape where it engages with an interior of the compressor flange.

9. A method of lifting fluid in a wellbore, comprising:

running an electric submersible pump (ESP) assembly into the wellbore, wherein the ESP assembly comprises an electric motor having a first drive shaft;

a tubular housing;

a second drive shaft disposed at least partly inside the tubular housing that is coupled to the first drive shaft;

a fluid mover disposed inside of the tubular housing that is coupled to the second drive shaft; and a shaft stop assembly coupled to the second drive shaft comprising a collet disposed around the second drive shaft, wherein the collet defines a plurality of through bores, a compressor flange disposed around the collet and around the second drive shaft and engaging with the collet to compress the collet to form a friction fit with the second drive shaft, wherein the compressor flange defines a plurality of through bores, a compression stop disposed around the compressor flange and around the second drive shaft, wherein a first axial end of the compression stop abuts an end of the collet and wherein the compression stop defines a plurality of female threaded bores, and a plurality of bolts having male threads, wherein the plurality of bolts are threaded into the female threaded bores of the compression stop to compress the collet to form the friction fit with the second drive shaft;

providing electric power to the electric motor;

moving fluid by the fluid mover; and lifting fluid in a production tubing disposed in the wellbore and coupled to the ESP assembly.

10. The method of claim 9, further comprising transferring thrust from the fluid mover to the second drive shaft via the shaft stop assembly.

11. The method of claim 9, wherein the fluid mover comprises a plurality of impellers that are axially located by the shaft stop assembly.

12. A rotating machine, comprising:

a tubular housing;

a drive shaft disposed at least partly inside the tubular housing;

a component disposed inside of the tubular housing that is coupled to the drive shaft and configured to do work as the drive shaft rotates; and a shaft stop assembly coupled to the drive shaft comprising a shaft stop assembly coupled to the drive shaft comprising a collet disposed around the drive shaft, wherein the collet defines a plurality of through bores, and wherein the collet defines a plurality of gaps and wherein a first axial end of the compression stop abuts an end of the collet, a compressor flange disposed around the collet and around the drive shaft and engaging with the collet to compress the collet to form a friction fit with the drive shaft, wherein the compressor flange defines a plurality of through bores, a compression stop disposed around the compressor flange and around the drive shaft, wherein a first axial end of the compression stop abuts an end of the collet and wherein the compression stop defines a plurality of female threaded bores, and a plurality of bolts having male threads, wherein the plurality of bolts are threaded into the female threaded bores of the compression stop to compress the collet to form the friction fit with the drive shaft.

13. The rotating machine of claim 12, wherein a second axial end of the compression stop (A) abuts the component that is coupled to the drive shaft and configured to do work as the drive shaft rotates or (B) abuts a sleeve disposed around the drive shaft and coupled to the drive shaft, wherein the sleeve abuts the component that is coupled to the drive shaft and configured to do work as the drive shaft rotates.

14. The rotating machine of claim 12, wherein the component disposed inside of the tubular housing comprises an impeller.

15. The rotating machine of claim 12, wherein the rotating machine is a component of an electric submersible pump (ESP) assembly.

16. The rotating machine of claim 12, wherein the rotating machine is at least a part of a horizontal pump system (HPS).

17. The rotating machine of claim 12, wherein the collet comprises a plurality of gaps.

18. The rotating machine of claim 17, wherein at least some of the plurality of gaps are disposed at a first axial end of the collet and wherein at least some of the plurality of gaps are disposed at a second axial end of the collet.

19. The rotating machine of claim 12, wherein the collet comprises spring steel.

20. The rotating machine of claim 12, wherein an outside surface of the collet defines a conical frustum shape where it engages with an interior of the compressor flange.

* * * * *